US005292300A

United States Patent [19]

Bluemle

[11] Patent Number: 5,292,300

[45] Date of Patent: Mar. 8, 1994

[54] ENCLOSURE AND METHOD FOR MAKING THE ENCLOSURE

[75] Inventor: Martin Bluemle, Horhausen, Fed. Rep. of Germany

[73] Assignee: Winkler & Duennebier Maschinenfabrik und Eisengiesserei KG, Neuwied, Fed. Rep. of Germany

[21] Appl. No.: 909,313

[22] Filed: Jul. 6, 1992

[30] Foreign Application Priority Data

Jul. 8, 1991 [JP] Japan ..... 4122575

[51] Int. Cl.[5] ..... B31B 33/00; B31B 37/00

[52] U.S. Cl. ..... 493/231; 493/232; 493/918; 493/947

[58] Field of Search ..... 493/128, 130, 227, 228, 493/229, 231, 232, 235, 918, 947

[56] References Cited

U.S. PATENT DOCUMENTS 3,073,508 1/1963 Hiersteiner .
4,175,478 11/1979 Tripler ..... 493/248
4,294,400 10/1981 Gendron .
4,973,298 11/1990 Ferguson .

FOREIGN PATENT DOCUMENTS 172757 3/1952 Austria .
0091674 10/1983 European Pat. Off. .
421009 11/1925 Fed. Rep. of Germany .
1988230 6/1968 Fed. Rep. of Germany .
7040187 3/1971 Fed. Rep. of Germany .
7209364 7/1972 Fed. Rep. of Germany .
7326855 10/1973 Fed. Rep. of Germany .
7808597 11/1978 Fed. Rep. of Germany .
8812186 1/1989 Fed. Rep. of Germany .
1604993 8/1972 France .
202257 1/1939 Switzerland .
569632 11/1975 Switzerland .

*Primary Examiner*—William E. Terrell
*Attorney, Agent, or Firm*—W. G. Fasse

[57] ABSTRACT

An enclosure such as a letter envelope, a casing, shipping pouch, file folder, or the like, is made of paper or similar suitable material to have a front portion (3) and a back portion (4) as well as side flaps (6) and (7). The enclosure may be provided with a closure flap (23) that is either part of the front portion (3) or part of the back portion (4). A bottom portion (5) is arranged between the back portion (4) and the front portion (3), whereby the bottom portion is preferably an integral component of the front and back portions. The side flaps (6, 7) are provided with respective folding creases extending longitudinally and foldable bottom side tongues (18, 19) are provided at the bottom end of the side flap (6, 7). These basic features are common to a plurality of different enclosures which provide a substantially larger enclosed volume than heretofore.

2 Claims, 25 Drawing Sheets

1D
6D
23D
7D
10D
8D
8D
3D
9D
10D
9D
18D
5D
19D
4D
72D

ENCLOSURE AND METHOD FOR MAKING THE ENCLOSURE

FIELD OF THE INVENTION

The invention relates to an enclosure and to a method for making the enclosure. The term "enclosure" as used herein is intended to be a generic term for envelopes, casings, bags, shipping pouches and file wrappers or the like. Such enclosures have a front portion, a back portion, and side flaps as well as at least one closure flap. The closure flap may be part of the front portion and/or of the back portion. The invention also relates to a method for producing any of said envelopes, casings, etc.

BACKGROUND INFORMATION

The conventional self-adhesive letter envelope is flat and comprises two closure flaps, namely one flap on the front portion and another flap on the back portion. The side flaps are located at the front portion and are directly folded onto the front portion. The back portion is laid onto the side flaps and adhesively bonded with the side flaps. The form and configuration of said conventional letter envelope is very flat with the result that the number of sheets that can be enclosed in the conventional letter envelope is rather limited.

OBJECTS OF THE INVENTION

In view of the foregoing it is the aim of the invention to achieve the following objects singly or in combination:

- to manufacture an enclosure that provides a substantially larger enclosure volume than a conventional envelope of the same size, yet is simple to manufacture; and
- to provide a method for producing such an enclosure reliably and economically.

SUMMARY OF THE INVENTION

An enclosure according to the invention is characterized in that a bottom portion is provided between the front and rear portion in such a way that the bottom portion is an integral component of the front and rear portion, and that lateral or side flaps are constructed as side portions that are foldable longitudinally, and wherein the side flaps comprise bottom side tongues at their bottom ends. The enclosure further comprises a back foldable portion as part of one of the front portion or of the back portion and a back foldable precrease between the back foldable portion and the respective front portion or back portion, whereby the enclosure can be laid flat when empty, and whereby the enclosure provides a substantial space between its front and back portions when the enclosure is filled.

According to the invention, the present enclosures are manufactured in a continuous operation by subjecting a continuously advancing sheet material, such as paper, plastic, or the like, to a number of steps to form for each enclosure the above mentioned portions, namely a front portion, a back portion, side flaps, and a bottom portion, such steps comprising:

A) producing in said side flaps longitudinal first precreases which extend or lie outwardly in the finished enclosure;

B) producing in the side flaps longitudinal second precreases extending inwardly in the finished product;

C) producing of cross and angular precreases for said bottom portion, for a back foldable portion, and for said bottom side tongues;

D) cutting out of said bottom side tongues;

E) producing of the side flap folds by folding and inwardly displacing the side flaps, whereby outer folding sections of the side flaps are placed onto inner folding sections of the side flaps;

F) flapping and pulling the bottom side tongues backwardly and outwardly about a cross crease operating as a back folding precrease, and about angular precreases while tilting the bottom side tongues around 90°;

G) inwardly folding the bottom side tongues;

H) applying adhesive to the bottom portion or to the bottom side tongues;

I) back folding in a Z-configuration the back foldable portion onto the bottom portion, whereby simultaneously the bottom side tongues are flapped onto the bottom portion;

K) applying adhesive to the side flaps and/or to the outer sections of the side flaps; and L) folding and closing the back portion of the enclosure.

An enclosure according to the invention provides a packing volume, for example, as a letter envelope, which is several times larger than the volume of conventional letter envelopes. The bottom portion is flat when the enclosure is empty, and forms a stand-up bottom when the enclosure is filled. The bottom portion further comprises only a single layer which is reinforced at its corners or rather at its ends near the side flaps, by bottom side tongues which serve for closing and for adhesively bonding the enclosure bottom with the side flaps. When the enclosure is empty, it can easily be folded flat. The fat bottom functioning as a stand-up bottom makes it possible that the enclosure can be provided with any desired dimensions and that upon adapting the front portion or the back portion, the enclosure can be used as a casing or as a file folder that can be formed for use with its high side up or with its short side up. Similarly, the enclosure can be used as a shipping pouch. The material for making such enclosures is preferably paper, cardboard, or the like. The production starts with sheet material pulled off a roller or the blanks may be precut, whereby in both instances the type of folding is important. In order to assure such a folding, either the front portion or the back portion is provided according to the invention with a cross precrease for a back foldable portion which is arranged directly next to and parallel to the bottom portion.

When the blank has been completed and the side flaps have been folded, the bottom side tongues are flapped outwardly by 90° into a position parallel to the bottom portion where upon these side tongues are folded inwardly and the bottom portion is folded backwardly, so that the bottom side tongues and the back foldable portion come to rest on the bottom portion. In this position, the portions are interconnected or bonded to each other by means of an adhesive. The folding operation thus comprises only a few individual steps and these steps can all be safely performed by a machine. The result is an enclosure that has a flat bottom formed of a single layer that in the filled state of the enclosure forms a stand-up bottom.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
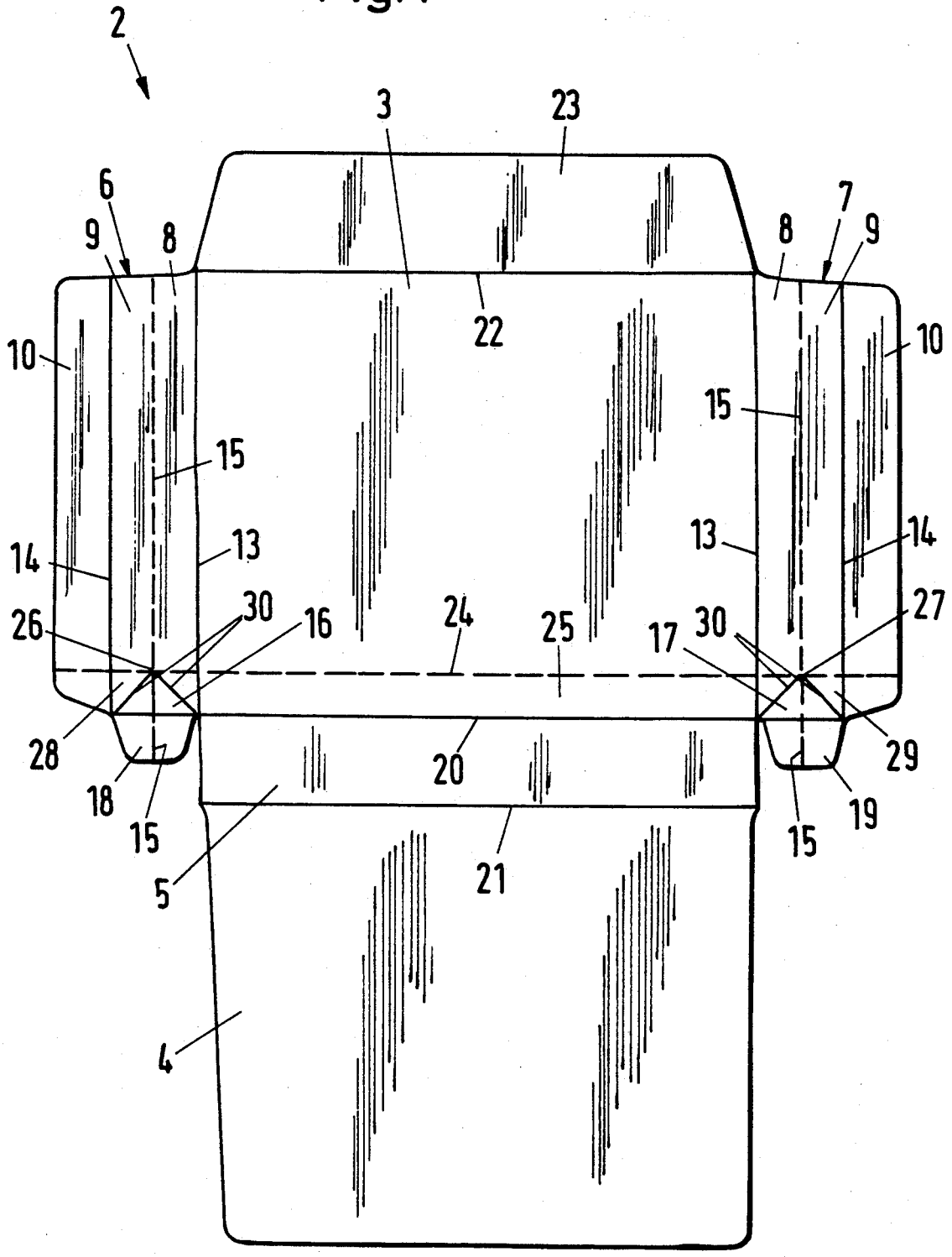
FIG. 1 is a developed plan view of a blank for an enclosure according to the invention prior to folding and gluing the portions together.
Figure 2:
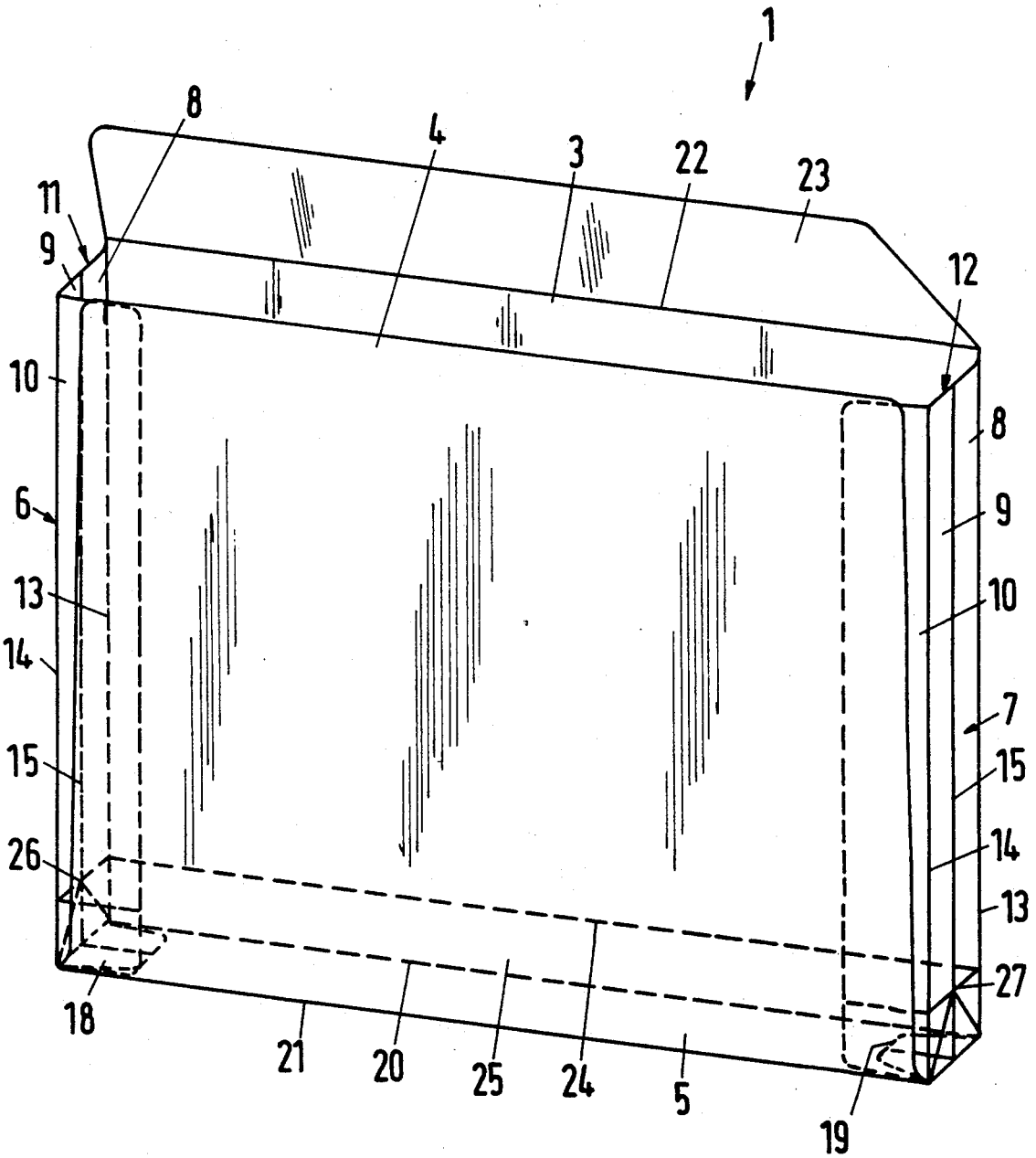
FIG. 2 is a perspective view of an enclosure according to FIG. 1 on a somewhat enlarged scale, and after gluing the portions together.

Referring to FIGS. 1 and 2, an enclosure according to the invention, such as a letter envelope 1 shown in FIG. 2, is preferably made of paper or cardboard. Such material is used also for the embodiments shown in the other figures. According to FIG. 1, the illustrated blank 2 comprises a front portion 3 and a back or rear portion 4 as well as a rectangular bottom portion arranged between the front portion 3 and the back portion 4.

The bottom portion is preferably an integral single piece part of the front and back portions. The blank 2 further comprises side flaps 6 and 7 secured laterally and outwardly to the front portion 3. Each of these side flaps has an inner folding section 8, an outer folding section 9, and a side flap outer portion 10. In the embodiment of FIGS. 1 and 2 the side flap outer portions 10 are constructed as gluing tongues for securing the back portion 4. The inner and outer folding portions 8 and 9 of the side flaps 6 and 7 form respective inwardly foldable side walls 11 and 12 of the letter envelope 1. For this purpose the blank 2 comprises longitudinal precreases 13 and 14 which extend outwardly in the finished product while side flap longitudinal precreases 15 are foldable inwardly in the finished product.

Each of the side flaps 6 and 7 has a foldable bottom side tongue 18, 19 at the respective bottom end 16 and 17. The bottom side tongues 18 and 19 project further than the side flaps outer sections 10 and extend laterally in alignment with the bottom portion 5. Further, the respective side flap longitudinal precreases 15 extend all the way into the bottom side tongues 18 and 19.

Cross creases 20 and 21 form the bottom portion 5 between the front portion 3 and the back portion 4. A further cross crease 22 forms a closure flap 23 as part of the front portion 3.

The cross crease 20 between the front portion 3 and the bottom portion 5 also extends into the bottom side tongues 18 and 19 for forming a folding or flapping axis for the bottom side tongues 18 and 19.

A further hinging precrease 24 in the front portion 3 extends in parallel to the bottom portion 5 and forms in the front portion 3 a hingeable back fold portion 25. The hinging precrease 24 extends also through the side flaps 6 and 7 and intersects at the crossings 26 and 27 with the side flap longitudinal precreases 15. The side flaps 6 and 7 have end pieces 28 and 29 located at the level of the back fold portion 25. These end pieces 28 and 29 comprise angular precreases 30 which diverge from the respective crossings 26, 27 of the side flap longitudinal precreases 15 with the back-fold precrease 24 symmetrically toward the bottom side tongues 18, 19. This feature makes it possible that the side flaps 6 and 7 can be folded in such a way that they fold into the position shown in FIG. 2, whereby these side flaps can be connected with the aid of an adhesive to the bottom portion 5.

Figure 3:
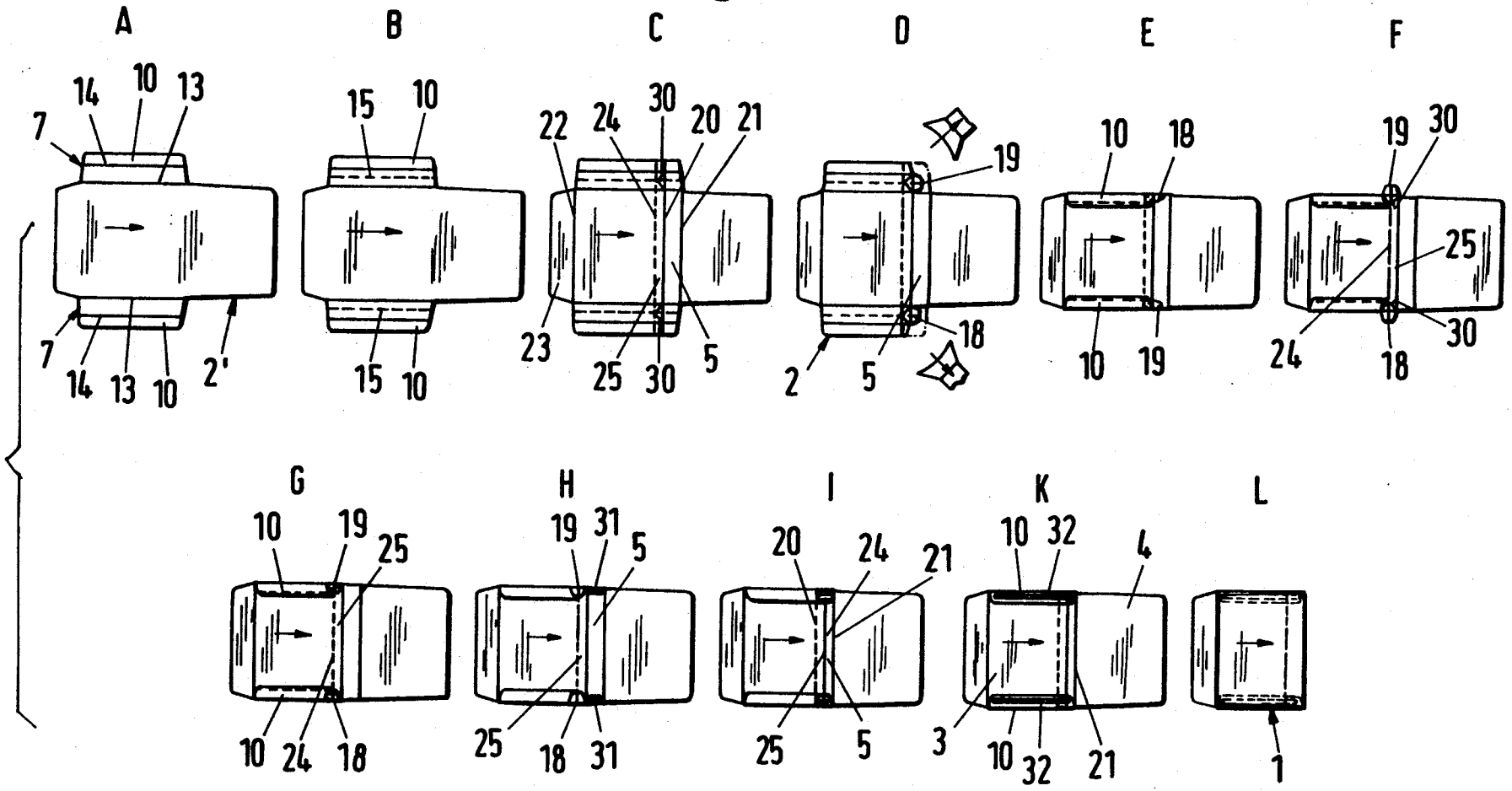
FIG. 3 illustrates a sequence of steps for producing an enclosure according to FIG. 2, whereby these steps are performed on a precut blank.

Referring to FIG. 3, the individual method steps for the production of a letter envelope 1 from a precut blank 2' will now be described, whereby it is clear that the blank 2' is shown on a smaller scale than blank 2 in FIG. 1. The first method step A involves the formation of the outwardly located longitudinal precreases 13 and 14 of the side flaps 6 and 7. The second method step B involves forming the longitudinal precreases 15 in the side flaps 6 and 7 permitting the inward folding of the side flaps 6 and 7. The third step C involves forming the cross precreases 22 for the closure flap 23, 24 for the back-fold portion 25, and both cross-creases 20 and 21 for the bottom portion 5.

The fourth method step D involves cutting out the bottom side tongues 18 and 19, thereby forming the bottom portion 5. When step D has been completed, the blank 2 is achieved as shown in FIG. 1. However, the bottom side tongues 18 and 19 could basically also be prepunched.

The fifth step E involves folding the side flaps 6 and 7, whereby the inner folding sections 8 are folded onto the front portion 3 and the outer folding sections 9 are laid onto the inner folding sections 8 and the side flap outer sections 10 are laid onto the outer folding sections 9. Further, the bottom side tongues 18 and 19 are folded toward each other, which is possible due to the side flap longitudinal precreases 15.

The sixth step F involves folding the bottom side tongues 18 and 19 outwardly, whereby these tongues flap around the back-fold cross crease 24, thereby tilting outwardly by an angle of 90° which is possible, due to the angular precreases 30. Simultaneously, the bottom side tongues 18 and 19 again open up.

The seventh step G involves flapping the bottom side tongues 18 and 19 inwardly about the cross precrease 20 which forms a flap axis and which constitutes a boundary for the bottom side tongues 18 and 19. As a result, the bottom side tongues come to rest with one half on the side flap outer sections 10 and with the other half on the back fold portion 25.

The eighth step H involves applying adhesive 31 either to the bottom portion 5 or to the bottom side tongues 18 and 19. Such application may be done as one adhesive track or line.

The ninth method step I involves a Z-shaped back-folding of the back-fold portion 25, whereby the latter flaps around the cross precrease 20 onto the bottom portion 5 and whereby simultaneously the bottom side tongues 18 and 19 are folded onto the outside of the bottom portion 5.

The tenth method step K involves applying an adhesive or an adhesive track 32 to the side flap outer sections 10 functioning as gluing tongues. Then, in the eleventh step L the back portion 4 is folded around the cross precrease 21, thereby closing the letter envelope 1 and placing the back portion 4 onto the outer sections 10 of the side flaps. Thus, the letter envelope 1 has been completed.

Figure 4:
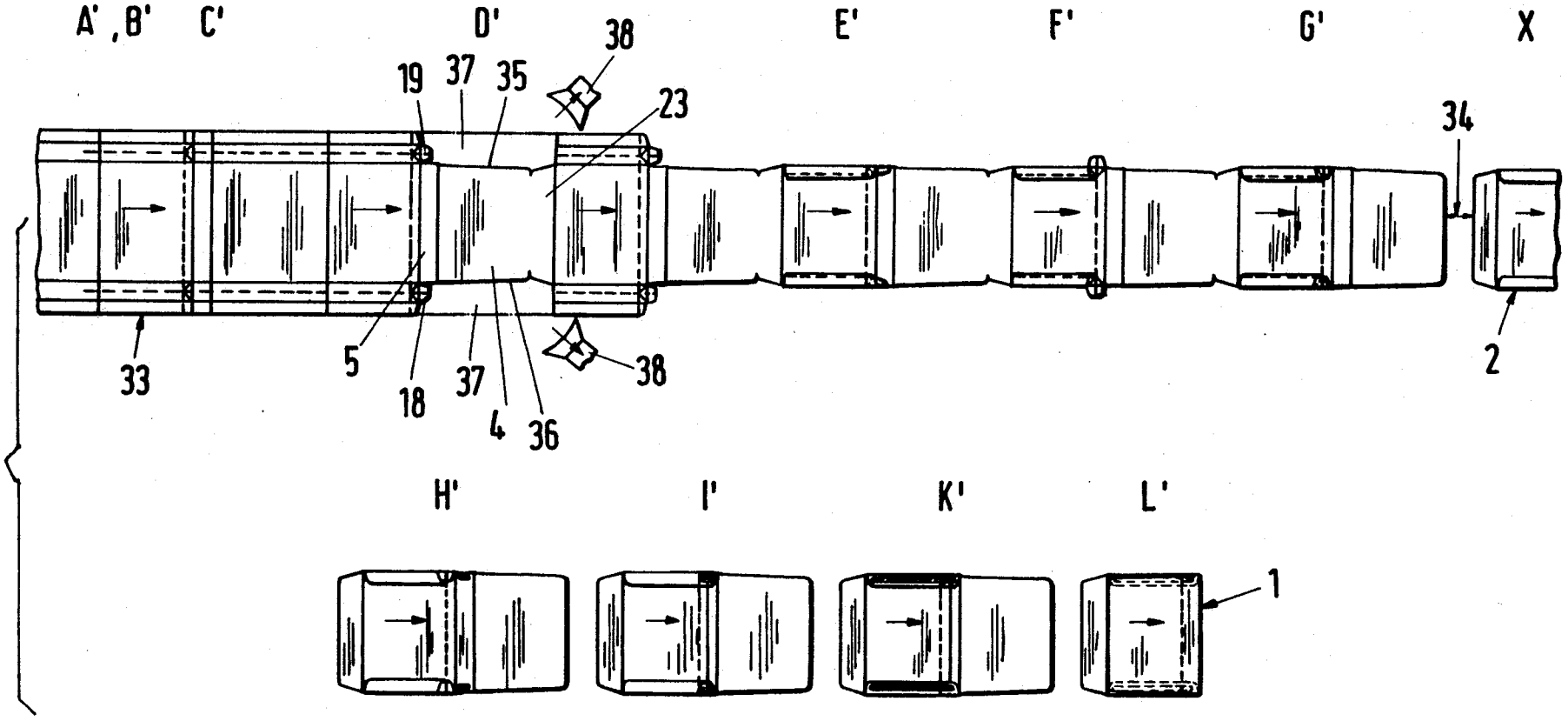
FIG. 4 illustrates the same sequence of steps as in FIG. 3, however, starting with a continuous web of sheet material.

FIG. 4 illustrates the manufacture of a letter envelope according to the invention, from a continuous web 33 pulled off a supply roller not shown, rather than performing the manufacturing steps on a precut blank as is illustrated in FIG. 3. However, there are no basic differences, except that a severing cut 34 needs to be made in method step X performed between the above described steps G and H to form the individual blank. Further, 20 in a method step D', a closure flap 23 for a neighboring blank is cut by the side cuts 35, 36, simultaneously with the cutting of the back portion 4, the bottom portion 5, and the bottom side tongues 18 and 19 for a preceding blank.

The waste portions 37 are removed by a suction device 38 on each side of the web 33. All other method steps A' to C', E' to G', and H' to L' are the same as described above with reference to FIG. 3.

Figure 5:
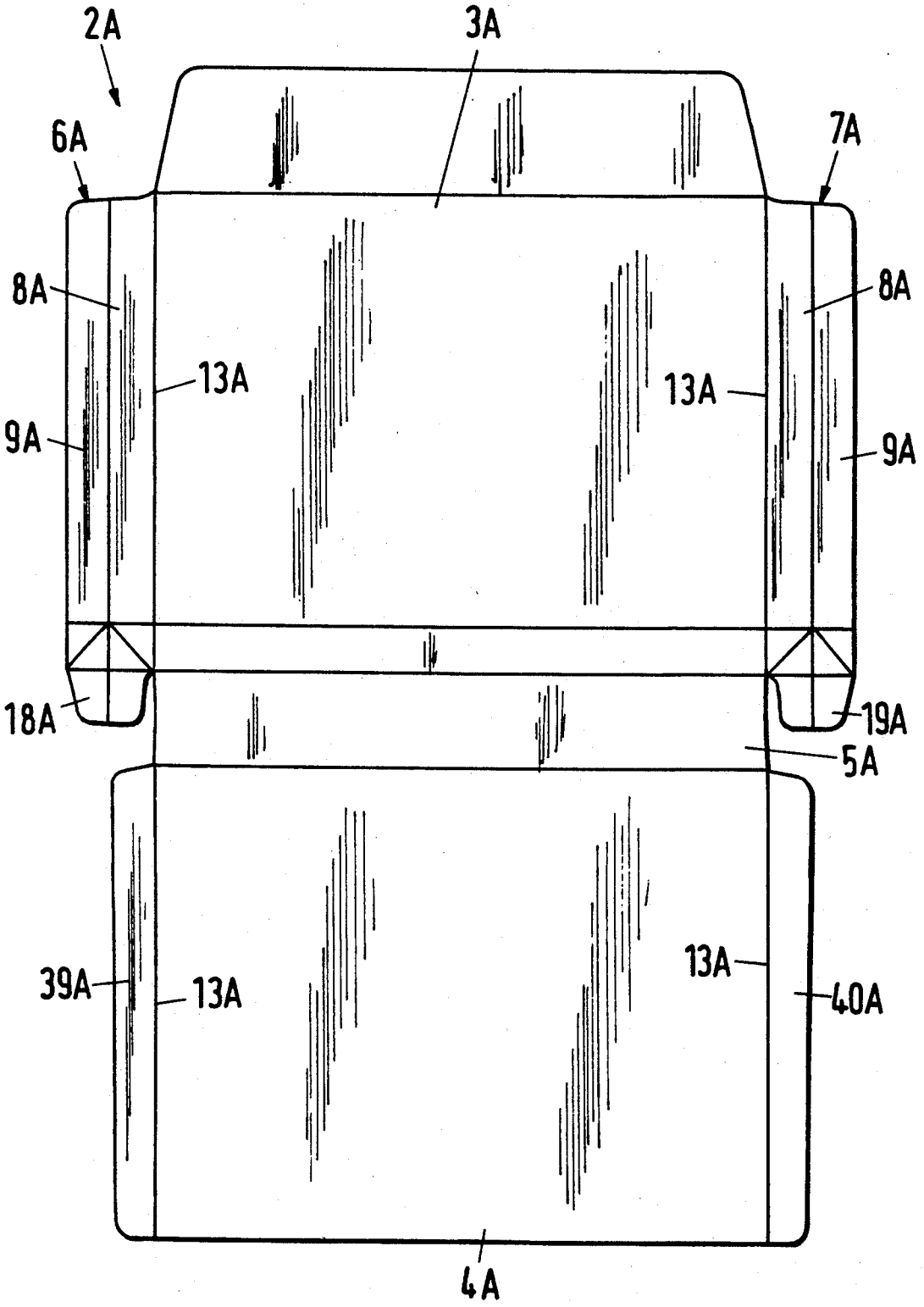
FIG. 5 shows a developed view similar to that of FIG. 1, but illustrating a modified blank for an enclosure according to the invention.
Figure 6:
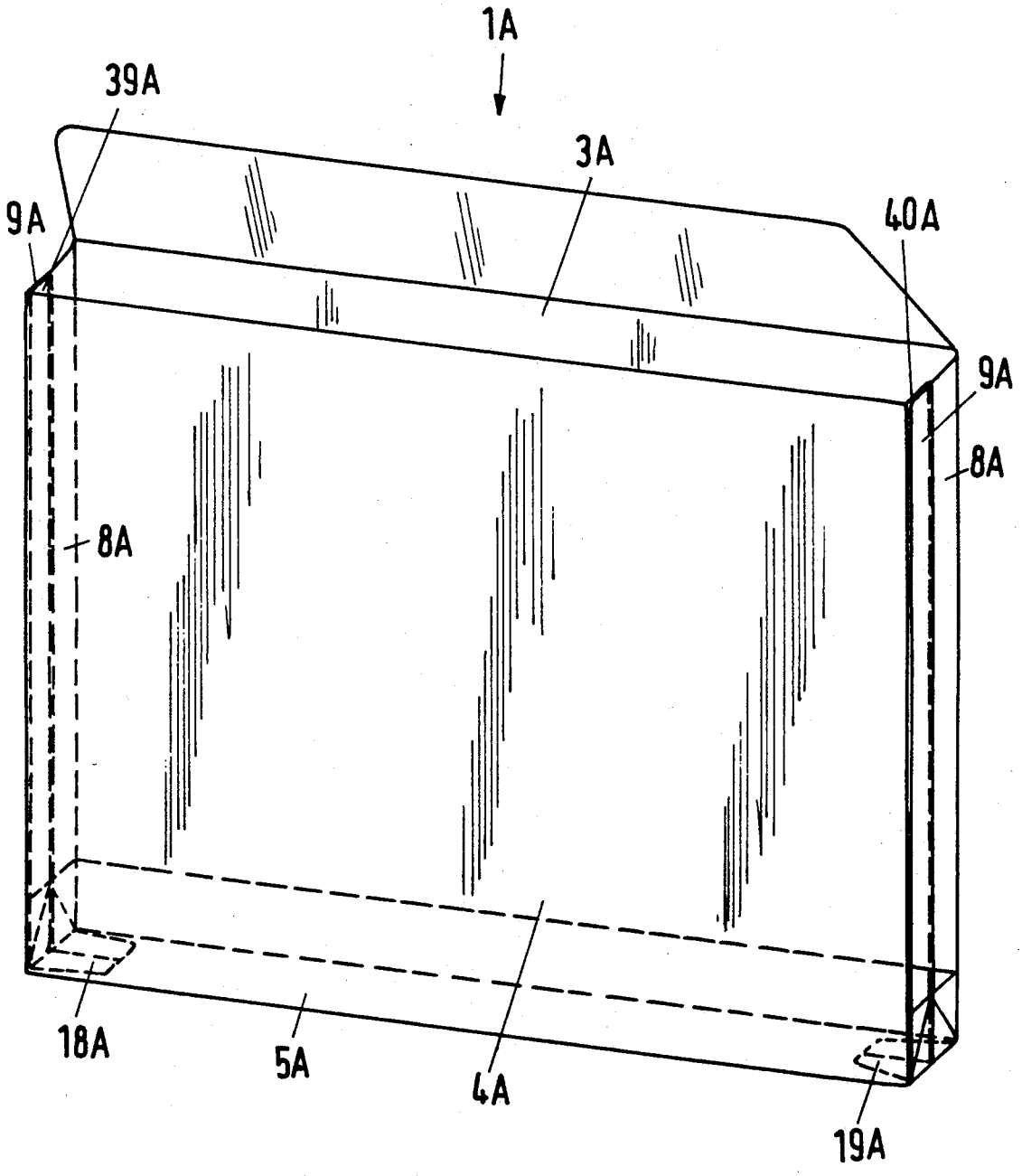
FIG. 6 is a perspective view of the enclosure according to FIG. 5 after assembly.

FIGS. 5 and 6 illustrate a modified letter envelope 1A which corresponds in substance to the letter envelope 1 so that the same elements are provided with the same reference numbers, however, with the index A added to the respective reference number.

Compared to the blank 2, the side flaps 6A and 7A of the blank 2A do not have the side flap outer sections 10 which serve as adhesive tongues in the blank 2. Instead, the blank 2A is provided at its back portion 4A with lateral flaps 39A and 40A that serve as gluing tongues. These laterial flaps 39A and 40A rest against the inner surfaces of the outer fold portions 9A of the side flaps 6A and 7A when the letter envelope 1A is closed. The side flaps 39A and 40A are glued to the inner surfaces of the fold portions 9A by means of an adhesive.

Figure 8:
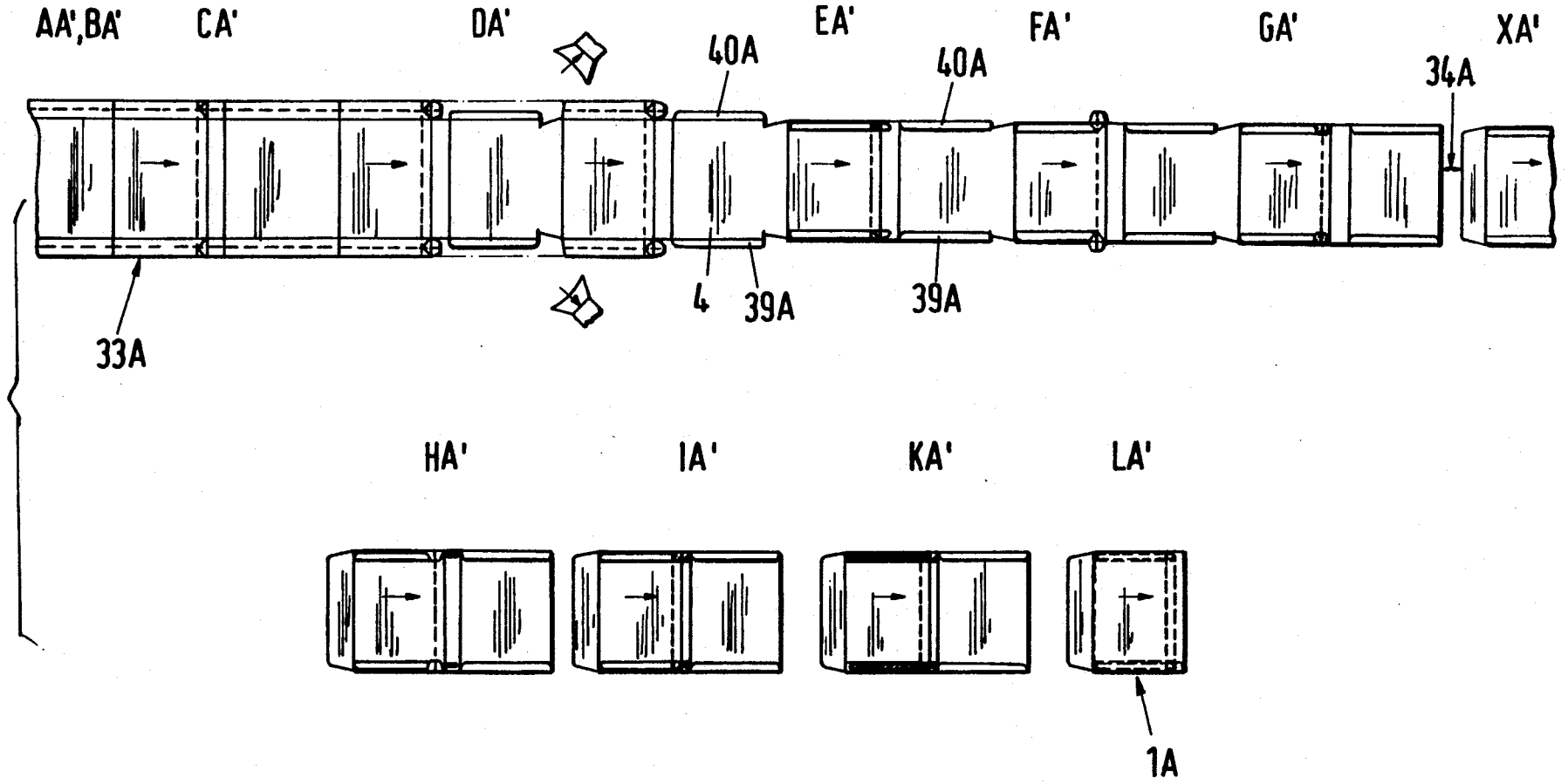
FIG. 8 is a view similar to that of FIG. 7, but illustrating the production from a continuous web of sheet materials.

The material web 33A, shown in FIG. 8, for the blank 2A is narrower than the blank 33, by the dimension of the side flap outer section 10 that is part of the blank 2 according to FIG. 1. Some material is saved by avoiding the side flap outer sections 9, 10 in the second embodiment in which the adhesive bonding is between the gluing tongues 39A, 40A of the back portion 4A and the fold portions 9A. Another advantage of the second embodiment is seen in that the outer surface of the back portion of the envelope can be printed without interference by envelope components such as side flaps on top of the back portion.

The two longitudinal precreases 13 of the blank 2 are also provided as longitudinal precreases 13A in the blank 2A and the precreases 13A extend from the front portion 3A to the back portion 4A where these precreases 13A form flapping axes for the side flaps 39A and 40A serving as gluing tongues.

Figure 7:
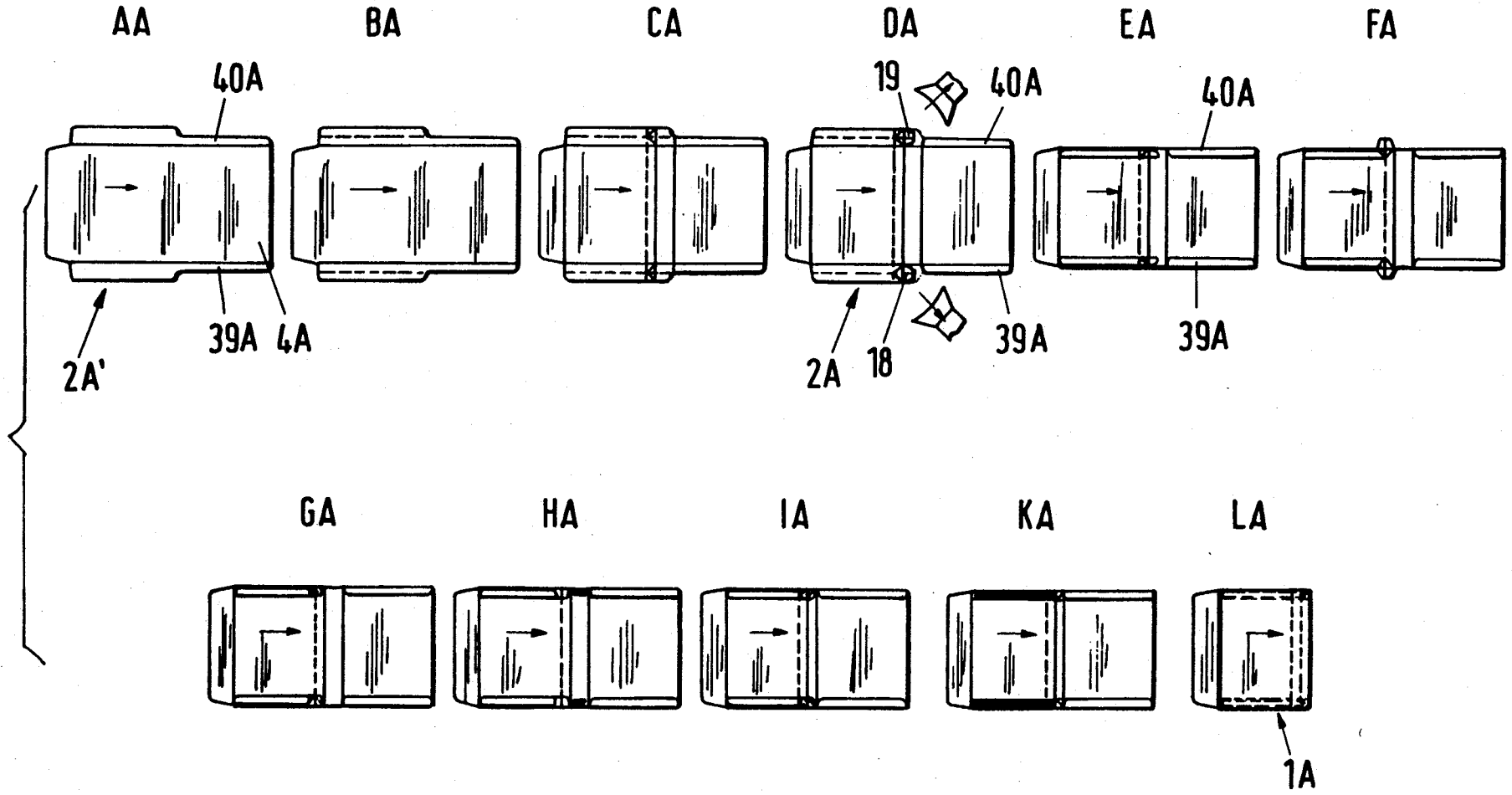
FIG. 7 illustrates the production steps for manufacturing an enclosure according to FIG. 6, while starting from a prepared blank.

FIG. 7 shows the several method steps for producing the letter envelope 1A by starting with a precut blank 2A' which does not have any side flap outer sections, compared to the blank 2'. Instead, the blank 2A' comprises side flaps 39A and 40A forming part of that portion of the blank which later, as the steps proceed, becomes the back portion 4A. The method steps AA to CA are the same as those for making the letter envelope 1. During the step DA the lateral cut for producing the bottom side tongues 18A and 19A also forms the bottom end of the side flaps 39A and 40A. During the method step EA, the side flaps 39A and 40A are folded over. All other method steps are then identical or analog to the method steps A to L as described above with reference to the first example embodiment.

FIG. 8 illustrates the method steps AA' to LA' for the production of a letter envelope 1A starting with a continuous web 33A taken off a roller not shown. The individual steps correspond substantially to the method steps A to L as shown in FIG. 1. In FIG. 8 the severing cut 34 takes place between the method steps GA' and XA', whereby further in FIG. 7 during the steps EA', the gluing tongues formed by the side flaps 39A and 40A are folded over.

Figure 9:
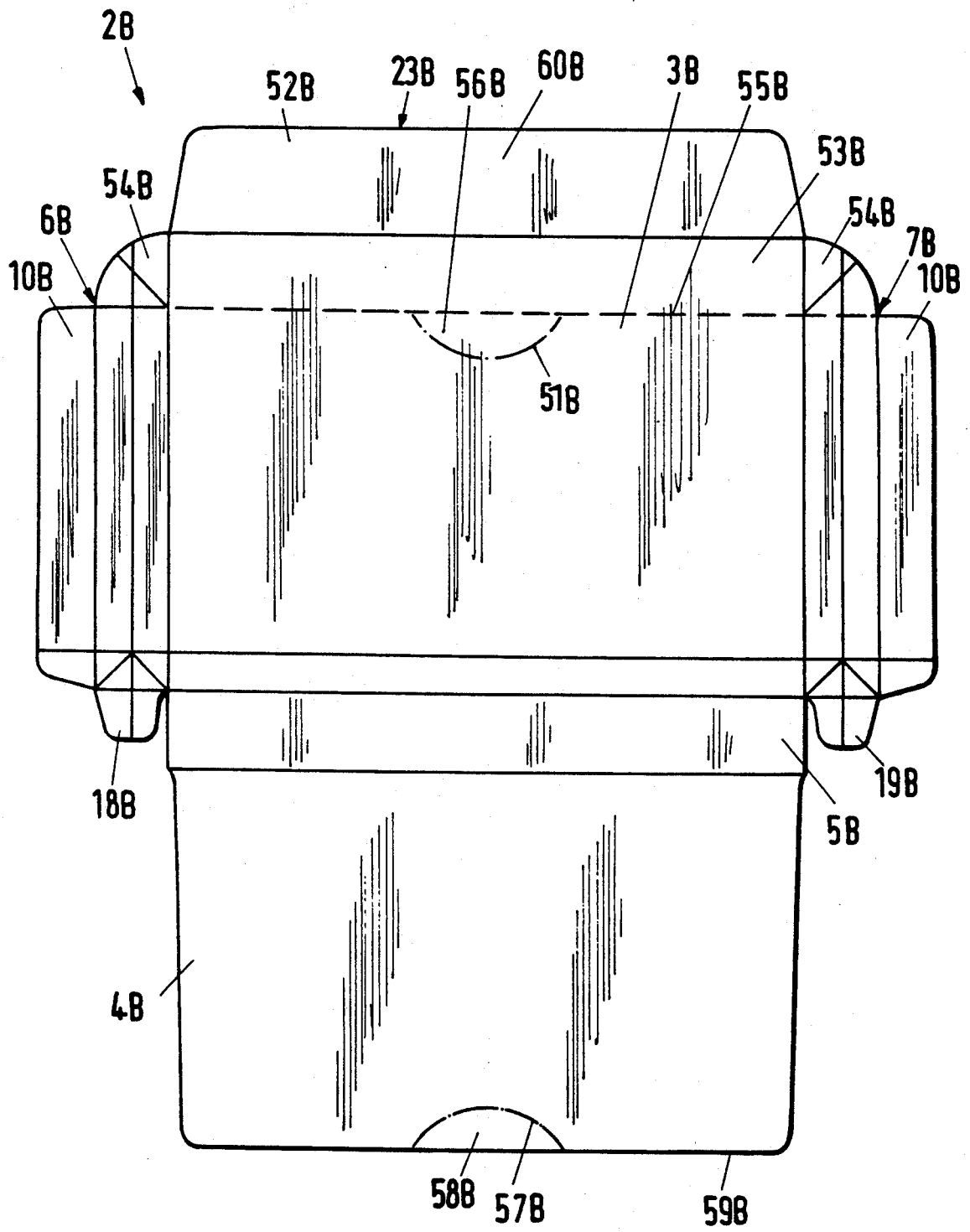
FIG. 9 illustrates a developed view of a blank for a book package package or casing.
Figure 10:
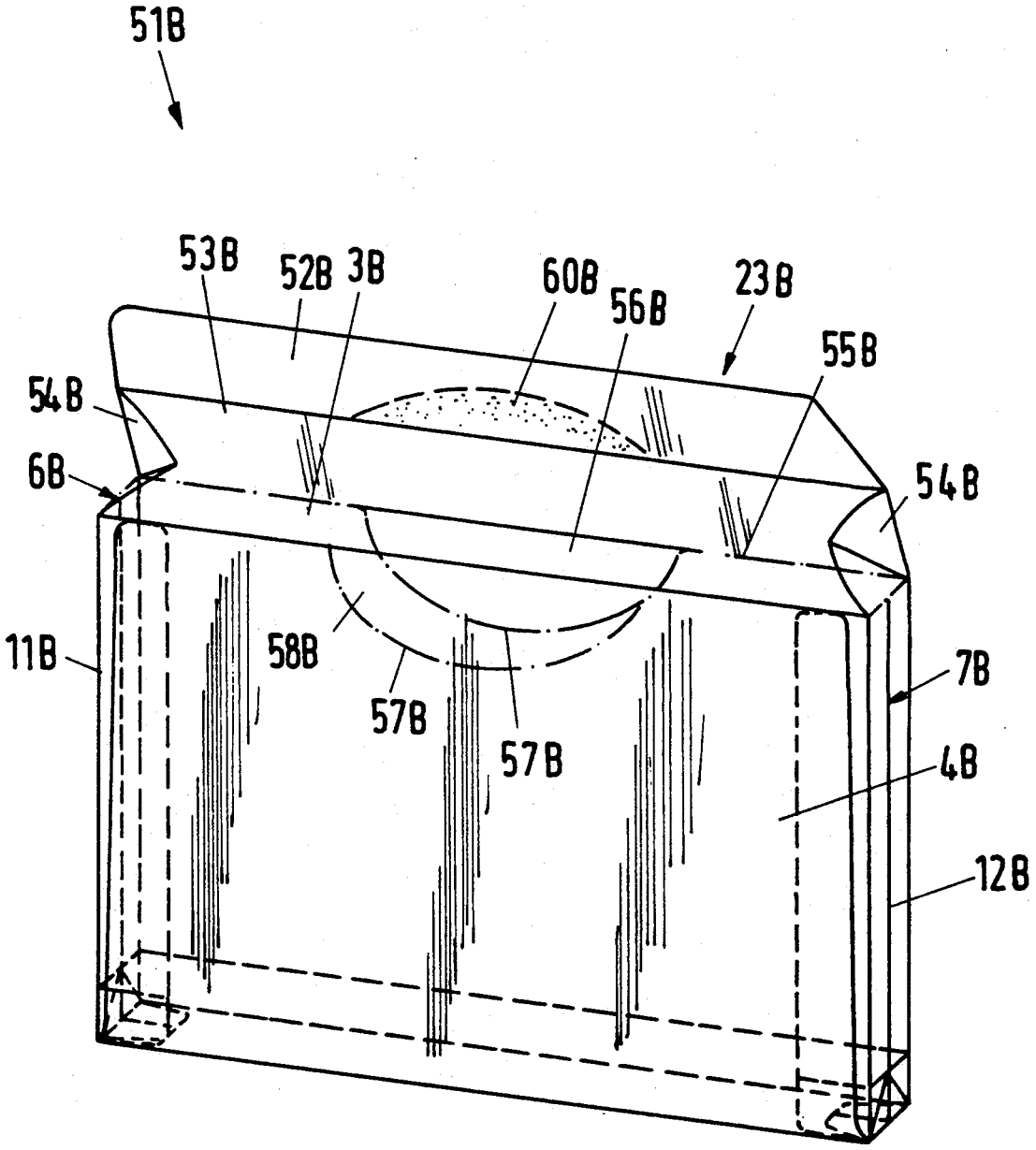
FIG. 10 is a perspective view of the book package or casing produced from the blank shown in FIG. 9.
Figure 11:
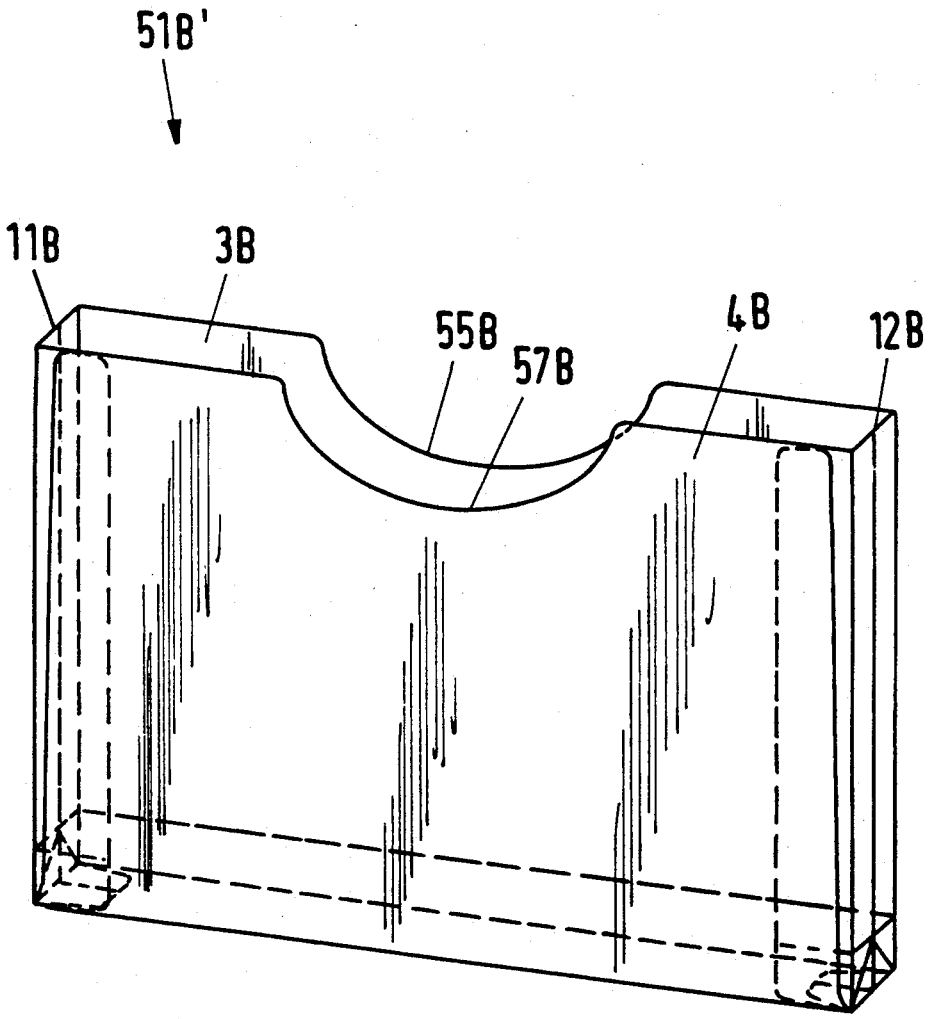
FIG. 11 is a perspective view of another book casing according to the invention without a closure flap compared to the book casing of FIG. 10.

FIG. 9 shows a blank 2B for producing a book package 51B shown in FIGS. 10 and 11. Most features of the blank 2B are the same as those of blank 2 of the first example embodiment, so that the same features are provided with the same reference numbers, except for the package or book casing, the index B is added to the reference numbers. The same applies for the reference numbers of the further example embodiments and the respective letter indices.

The book package or book casing 51B of FIG. 9 has a characteristic cross format which means the short sides of the casing extend vertically. Further, the closure flap 23B of the book casing has several sections. Specifically, the closure flap 23B comprises an outer section 52B, a cover section 53B, and angular gussets 54B. These gussets 54B form closure side portions which comprise precreases for folding. One side of the gussets is connected with the cover section 53B and the other side of the gussets is connected with the side sections 11B and 12B of the side flaps 6B and 7B in proper alignment. However, basically other closure configurations are possible which operate satisfactorily without the gussets 54B. Further, it is possible according to the invention to manufacture book casings or covers in the long side up format. However, the short side up format has the advantage that the casing may be modified to form an insert envelope for a book as shown in FIG. 11.

As shown in FIG. 10, a characteristic feature of the book packaging casing 51B is the connection of the closure flap 23B with the front portion 3B through a rated fraction line 55B, whereby the rated fraction line 55B extends all the way into the side flaps 6B and 7B where it limits the angular gussets 54B. A further feature of the casing 51B is the curved intermediate portion 57B of the rated fraction line 55B in the front portion 3B, whereby the curved fraction line portion 57B forms a circular segment 56B in the front portion 3B. Another rated fraction line 57B also forming a circular segment 58B is provided at the free rim or edge 59B of the back portion 4B of the book casing. The circular segments 56B and 58B are located in register with each other when the book packing envelope or casing 51B is finished as may be seen in FIGS. 10 and 11.

The outer portion or section 52B of the closure flap 23B is glued to the back portion 4B, for example, by means of an adhesive in an area 60B cooperating with the circular segment 58B of the back portion 4B. The size of the surface area 60B is not critical.

As shown in FIG. 11, the closure flap of FIG. 10 may simply be removed along the rated fraction lines 55B and 57B, whereby the angular gussets 54B on the front portion 3B and the circular segment 58B of the back portion 4B are also removed so that an open sided book envelope 51B' is obtained, said envelope functioning as a protection for the book.

All other features including the type of folding and the production are the same for the book packaging envelope or casing 51B as for producing the letter envelope 1 so that a further discussion is not necessary.

Figure 12:
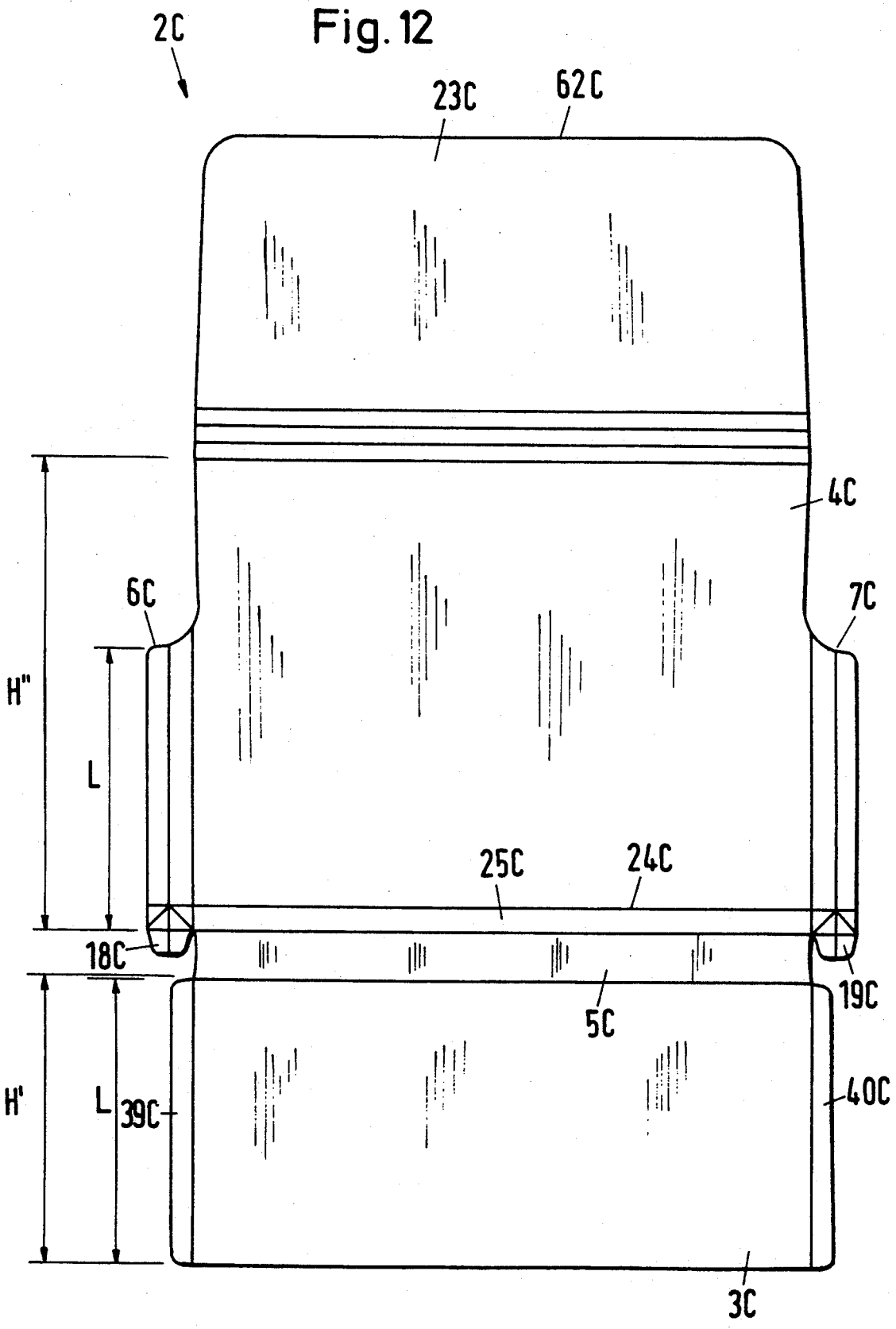
FIG. 12 is a developed view of a file wrapper arranged with its short side up prior to gluing.
Figure 13:
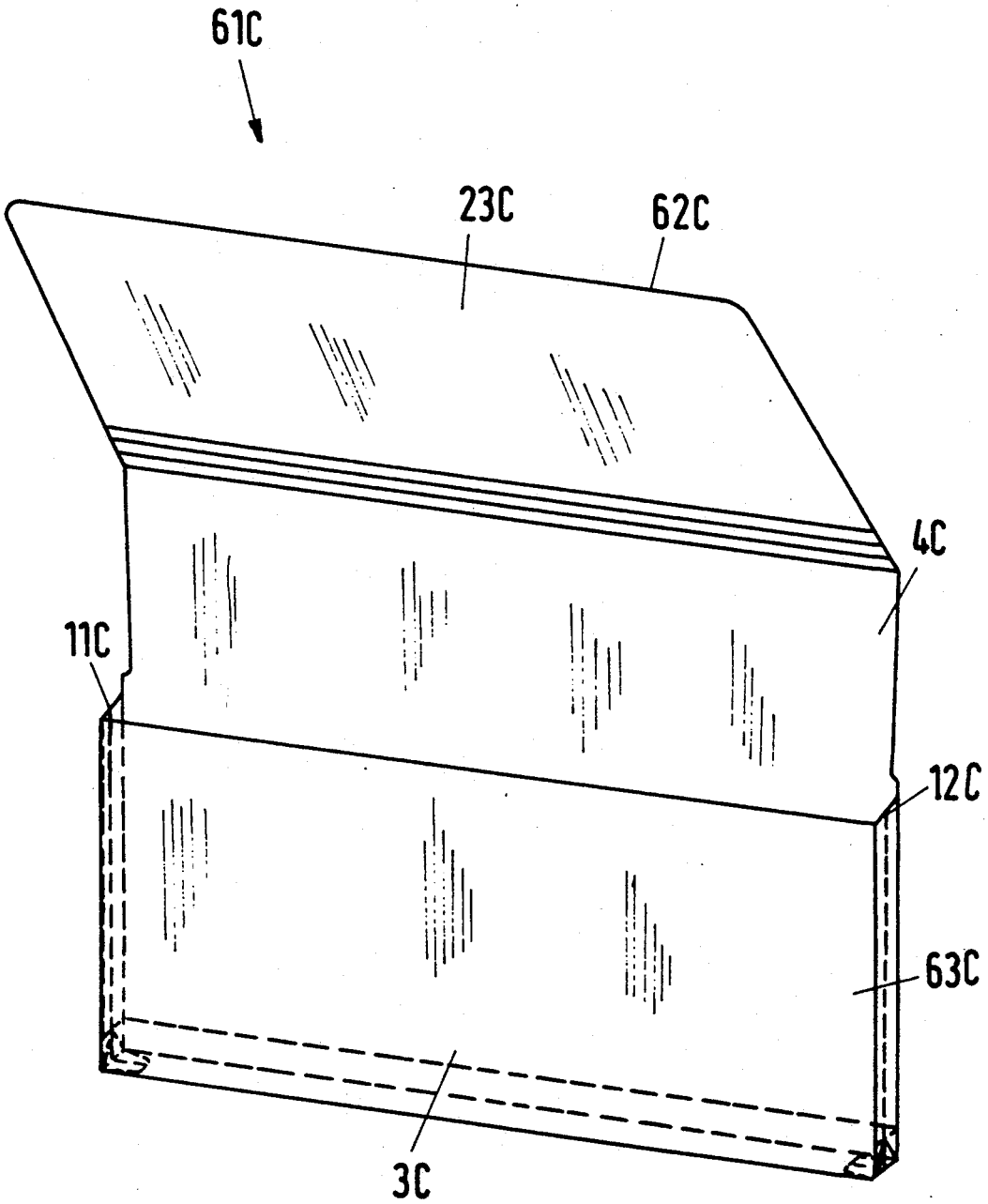
FIG. 13 is a perspective view of the file wrapper according to FIG. 12.

FIG. 12 shows a blank for another embodiment of the invention, which is shown in a perspective view in FIG. 13 illustrating a file folder or file wrapper 61C produced from a precut blank 2C shown in FIG. 12. An important feature of this embodiment is the fact that the side flaps 6C and 7C forming the side sections 11C and 12C are not arranged at that portion of the blank 2C that later becomes the front portion 3C. Rather, these side flaps 6C and 7C are arranged on the back portion 4C. However, the manufacturing steps do not require any changes from those described above. According to FIG. 12, the height H' of the front portion 3C is smaller than the height H2' of the back section 4C.

As mentioned, the side flaps 6C and 7C are arranged on the back portion 4C and side flaps 39C and 40C forming gluing tongues are located along the front portion 3C. These gluing tongues have a height or length L just as the side flaps 6C and 7C, whereby this height or length L corresponds or is equal to the height H' of the front portion 3C.

The closure flap 23C also differs from the respective closure flap of the other embodiments, whereby the closure flap 23C extends with its free margins 62C all the way into the lower half 63C of the front portion 3C when the file folder is closed. Thus, the closure flap 23C is substantially larger than the respective closure flaps of the other embodiments.

Figure 14:
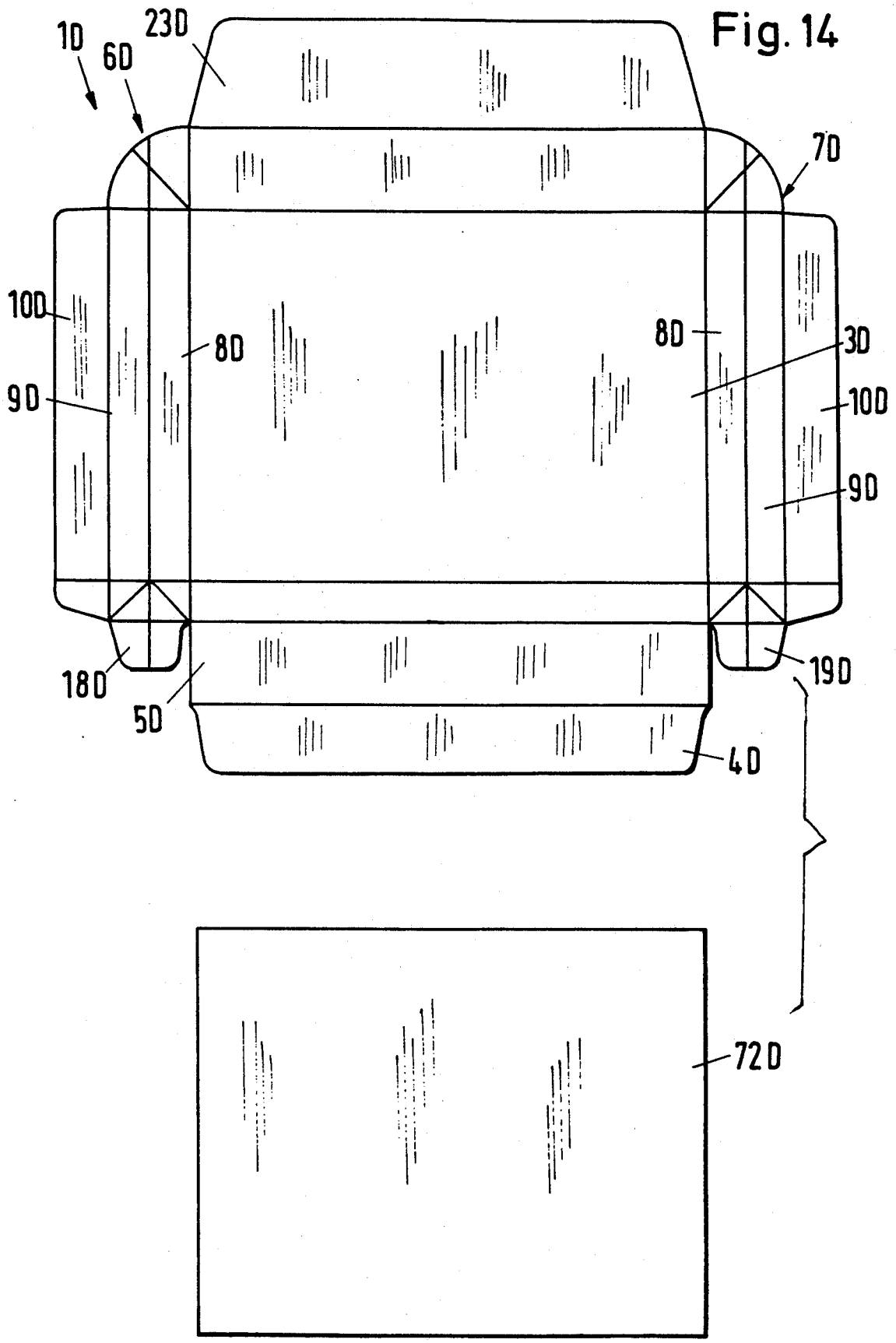
FIG. 14 is a developed view of a blank for a letter envelope with a stand-up bottom and a reinforced back portion.
Figure 15:
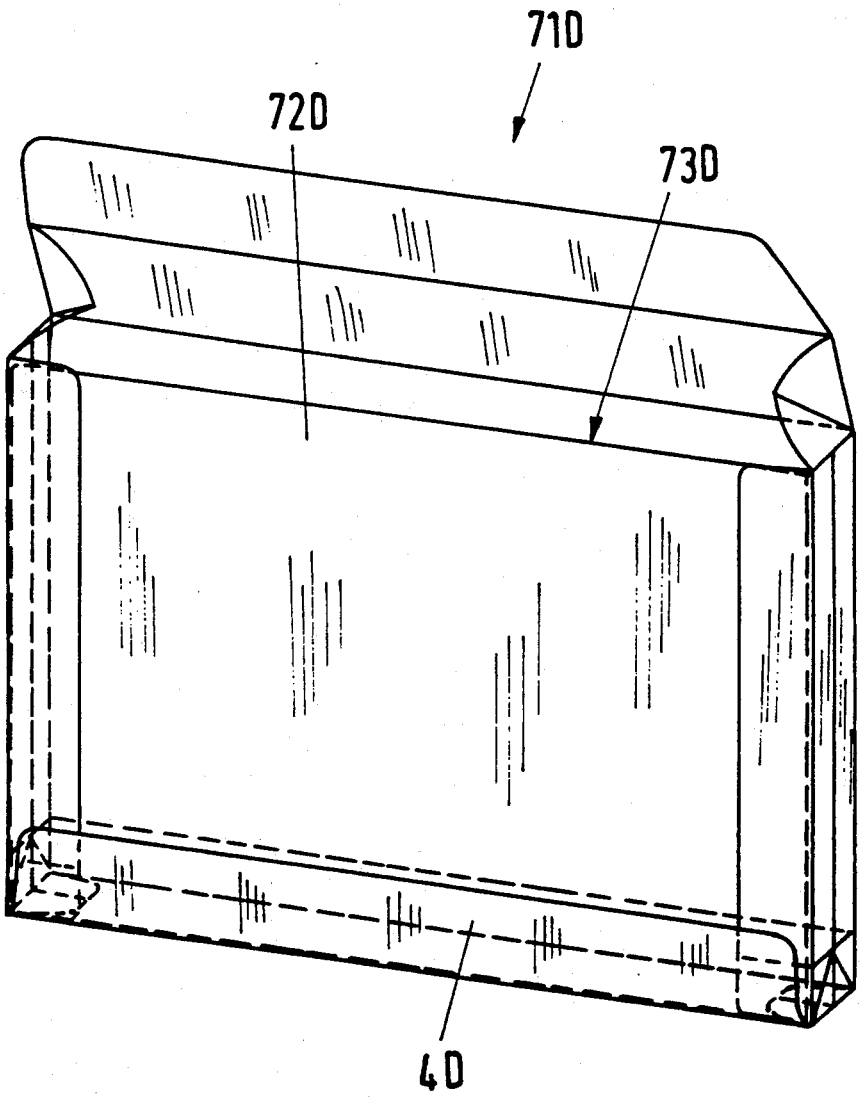
FIG. 15 is a perspective view of the letter envelope produced from the blank of FIG. 14.

FIGS. 14 and 15 illustrate a letter envelope 71D with a reinforcement section 72D in the area of the envelope back 73D. The letter envelope 71D corresponds in its important features to the letter envelope 1 and also to the book casing 51B as well as to the respective blanks 2 or 2B. However, a substantial difference resides in the fact that the back portion 4D is very short and functions only as a gluing tongue for the reinforcement section 72D. During the manufacturing steps, the reinforcement section 72D takes up the position of a long back portion and is secured to the blank with the aid of an adhesive. Otherwise, the method steps described above with reference to producing the letter envelope 1 are the same, especially the characteristic folding operations are the same.

Figure 16:
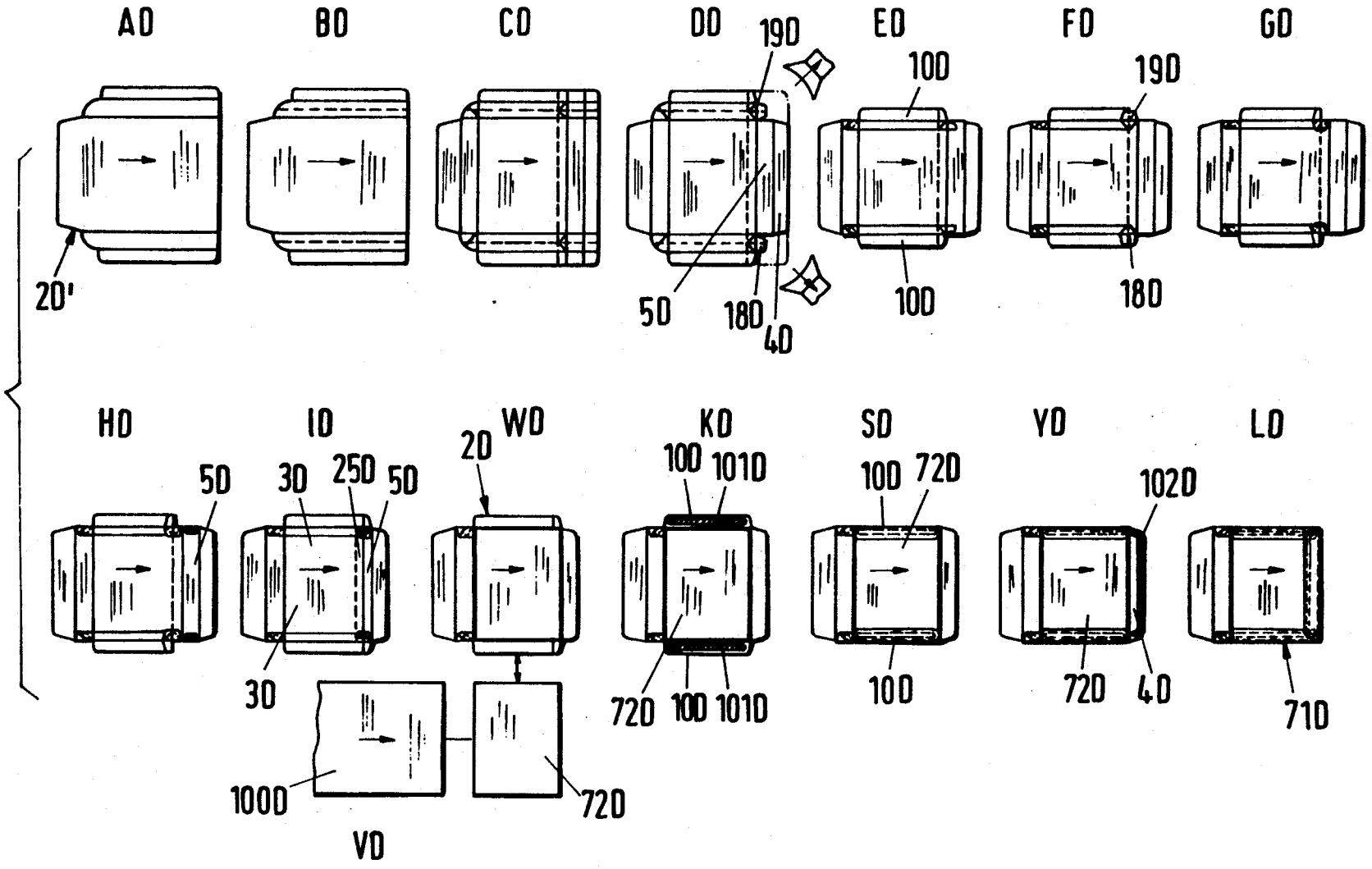
FIG. 16 shows the sequence of steps for the production of a letter envelope according to FIG. 15, starting with a precut blank.

FIG. 16 illustrates the method steps for producing the letter envelopes 71D the back of which is formed by the reinforcing section 72D, whereby the manufacturing starts with a precut blank 2D'. However, it should be noted that the section 72D does not need to be a reinforcing section. Section 72D could be an added part or a supplemental sheet enabling the producing of letter envelopes of larger size without increasing the machine width.

The longitudinal and cross creases are produced during the method steps AD, BD, and CD. During the method step DD the bottom side tongues 18D and 19D are cut-out together with the bottom portion 5D and with the short back portion 4D. The method step ED refers to the folding of the side flaps, whereby only the inner fold sections 8D and the outer fold sections 9D are folded onto each other or onto the front portion 3D. At this time, the side flap outer sections 10D which function as gluing tongues still remain unfolded.

The method steps FD, GD, HD, and ID are the same as in the other example embodiments and relate to the outward flaps FD of the bottom side tongues 18D and 19D to the back folding GD of the bottom side tongues 18D and 19D as well as to the glue application Hd to the bottom side tongues or to the bottom portion 5D. During the last step ID, the front portion 3D and the bottom portion 5D are folded over in a Z-shape with the help of the back fold section 25D, whereby the bottom side tongues 18D and 19D are connected to the bottom portion 5D with the aid of an adhesive bonding.

During step VD, the reinforcement section 72D is severed from a material web 100D. This reinforcement section 72D forms, as mentioned, the back portion of the letter envelope 71D. During step WD, the reinforcing section 72D is placed in register with the front portion 3D of the blank 2D that has been folded back during method step ID. Thereafter, during step KD, the side flap outer sections 10D are provided with adhesive along a track 101D. During method step SD the two side flap outer sections 10D are folded over onto the reinforcing section 72D. During step YD the short back portion 4D functioning as a gluing tongue is provided with an adhesive track 102D. In the last step Ld the back portion 4D is folded onto the reinforcing section 72D, thereby closing the letter envelope 71D which is thus completed.

Figure 17:
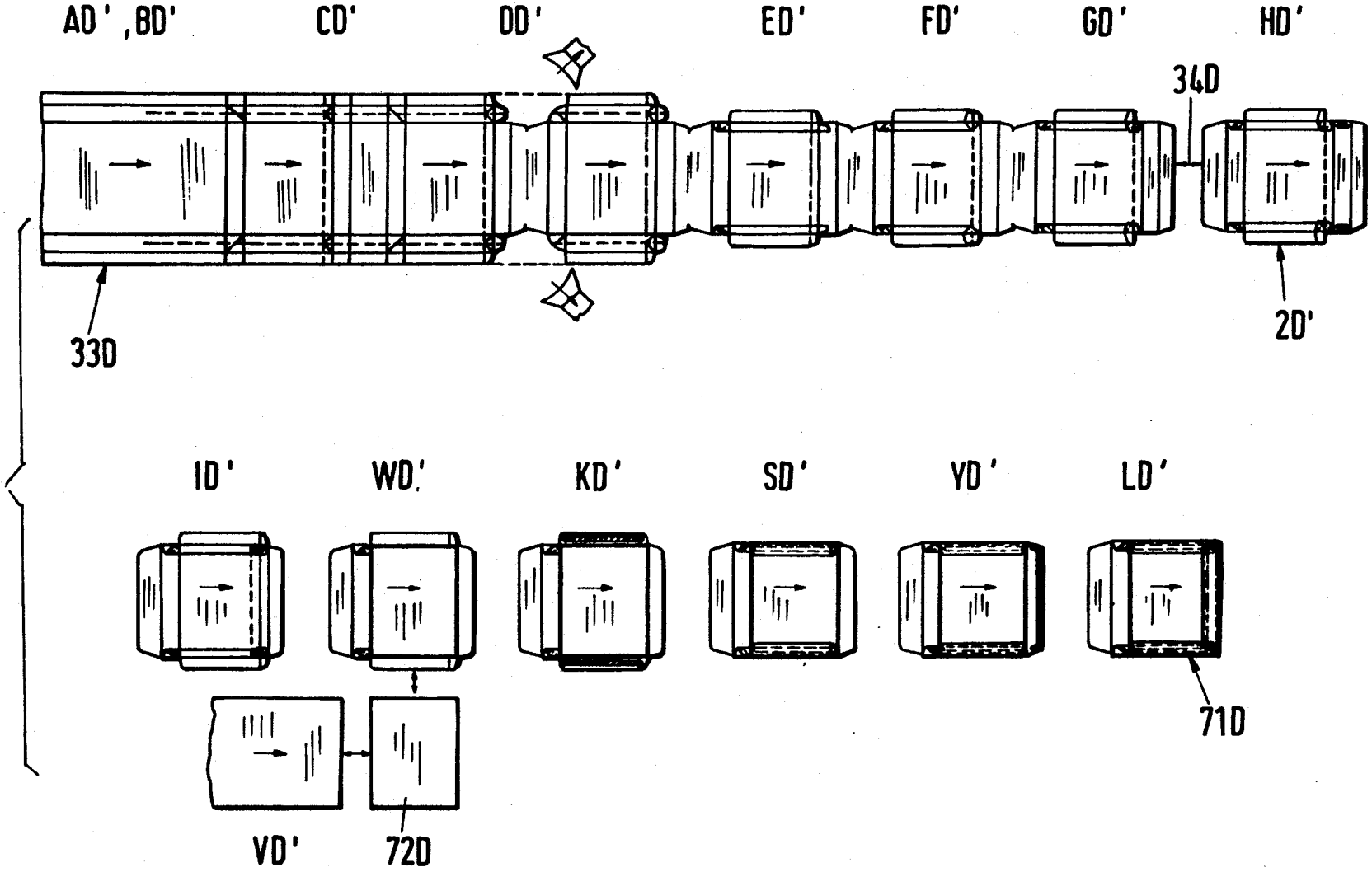
FIG. 17 shows a sequence of steps as in FIG. 16, however, using a web of sheet material from a roller.

FIG. 17 shows the corresponding method steps, compared to FIG. 16, if the letter envelope 71D is produced from a continuous web 33D rather than from precut blanks. Steps AD' to LD' are performed as the material web 33D is pulled off a supply roller not shown. The longitudinal and cross precreases are formed during method steps AD' to DD'. Further, the contour of the rated fraction lines, except for the severing section 34D, are made between method steps GD' and HD'. Otherwise, the steps ED' to HD' are identical to those performed when using a precut blank 2D' according to FIG. 16. The same consideration applies for the steps ID' to LD' corresponding to the respective steps when using a precut blank 2D' according to FIG. 16.

Figure 18:
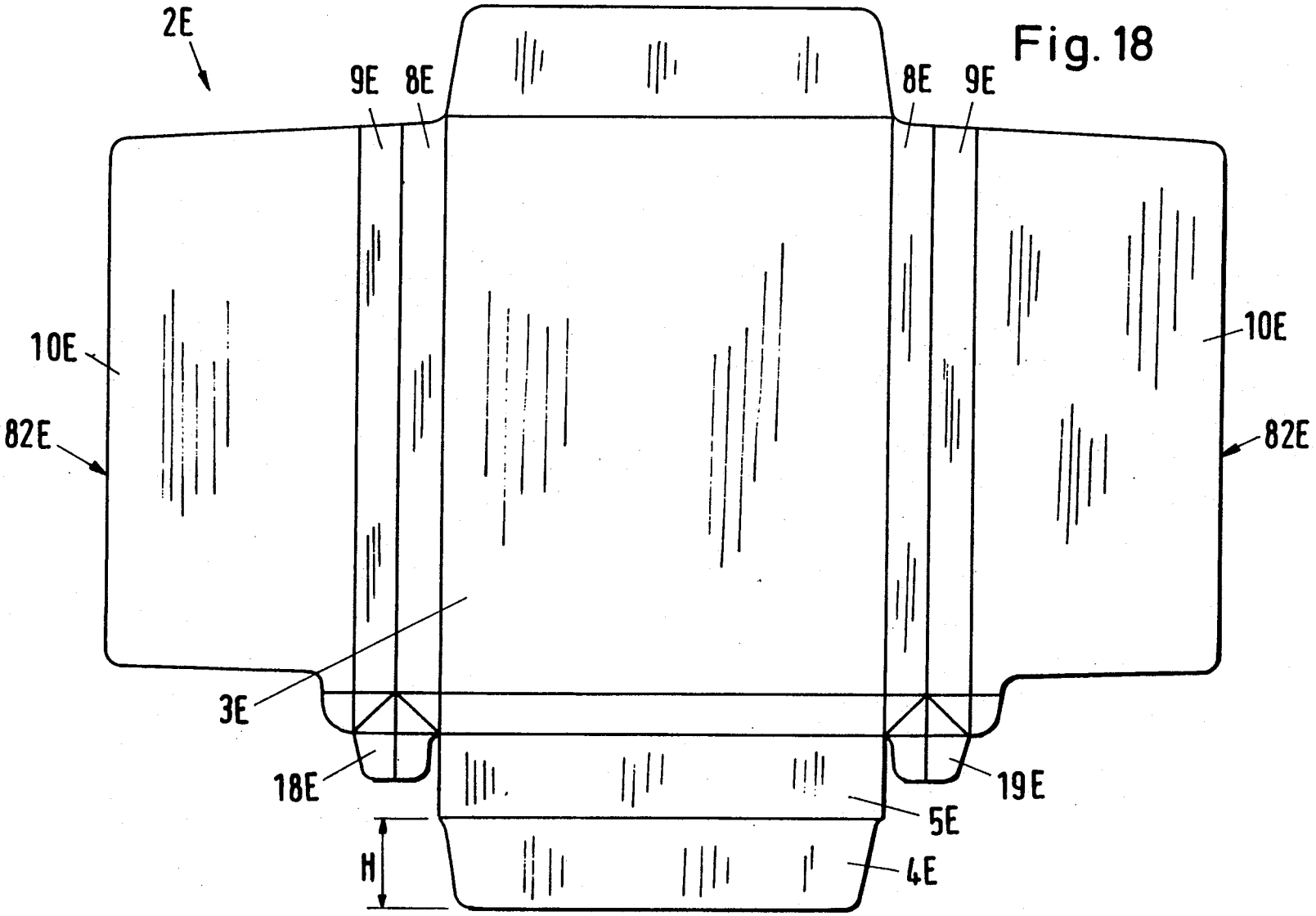
FIG. 18 is a developed view of a packing pouch with a flat stand-up bottom.
Figure 19:
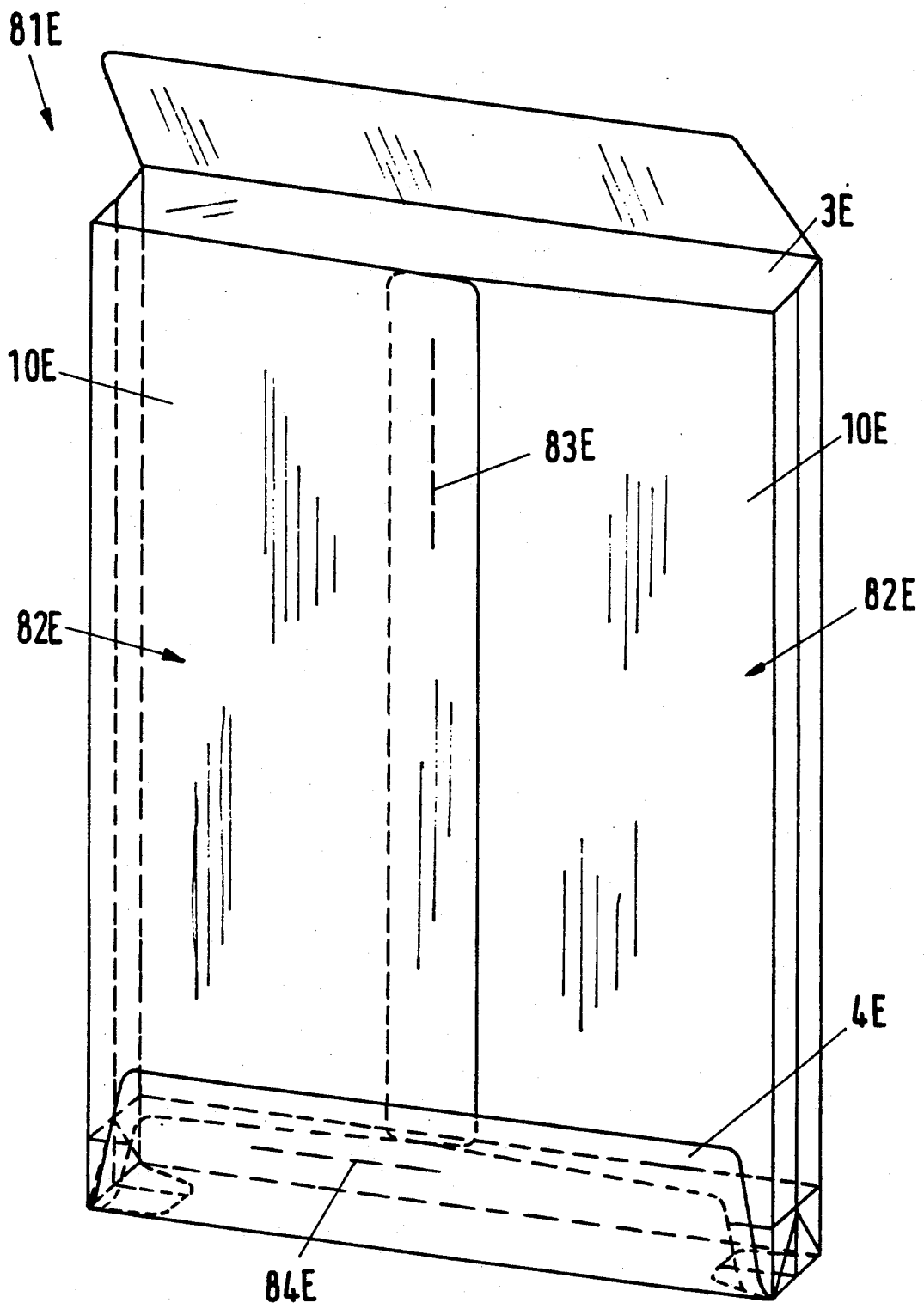
FIG. 19 is a perspective view of the shipping pouch produced from the blank shown in FIG. 18, however, shown on a somewhat reduced scale.

FIG. 18 shows a further embodiment according to the invention in which a precut blank 2E is used to make a shipping pouch 81E shown in FIG. 19. In this embodiment the back portion 4E also functions merely as a gluing tongue and hence has a substantially smaller height H than the front portion 3E. Further, the side flap outer sections 10E form respective half portions 82E of the back of the envelope. The half sections 82E are interconnected by means of an adhesive 83E as seen in FIG. 19. Additionally, the half sections 82E are glued to the short back portion 4E by an adhesive 84E. The two back portion half sections 82E and the back portion 4E form together the entire back of the shipping pouch 81E.

Figure 20:
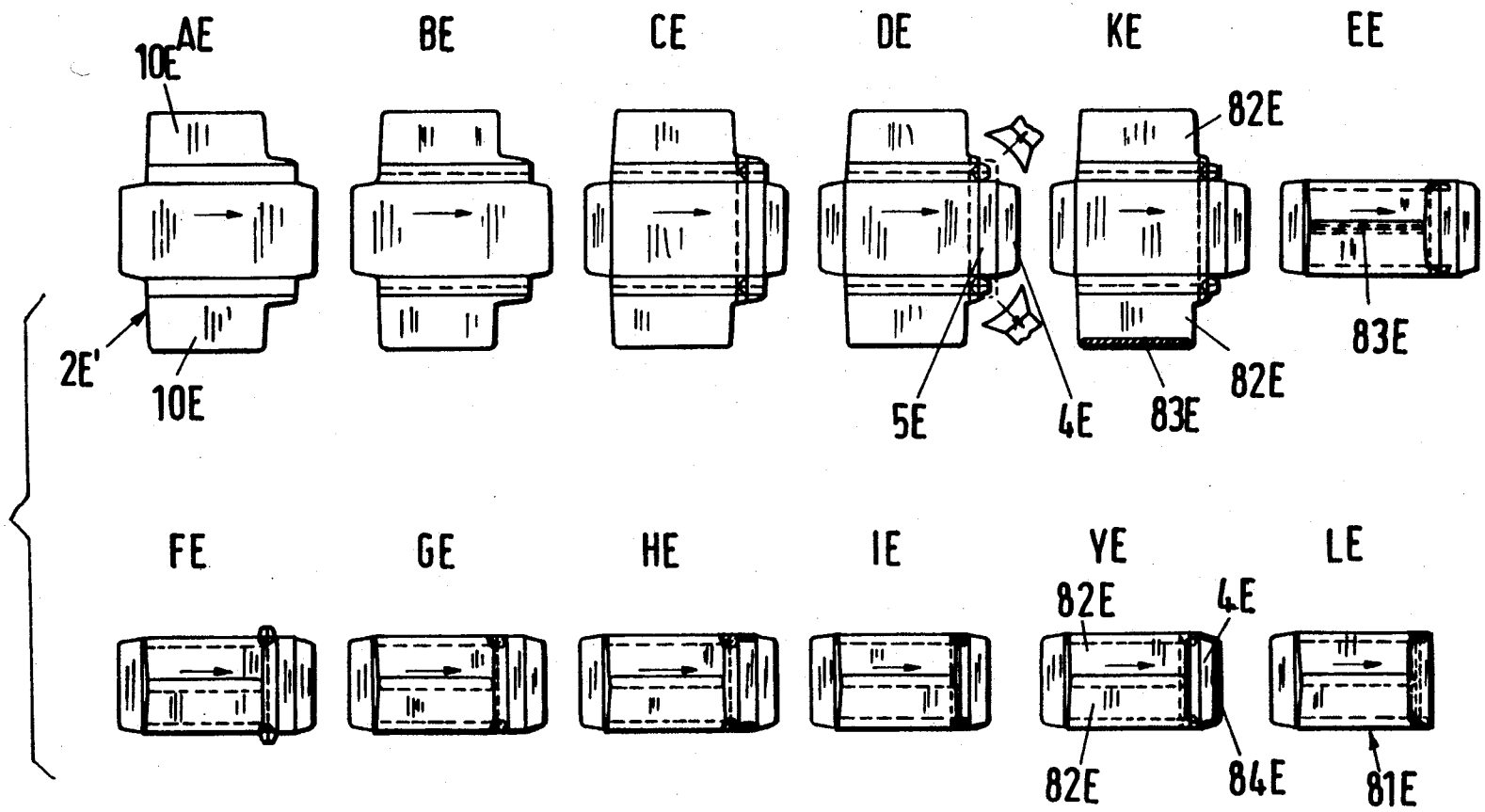
FIG. 20 shows the sequence of steps for producing a shipping pouch according to FIG. 19, while starting from a precut blank.
Figure 21:
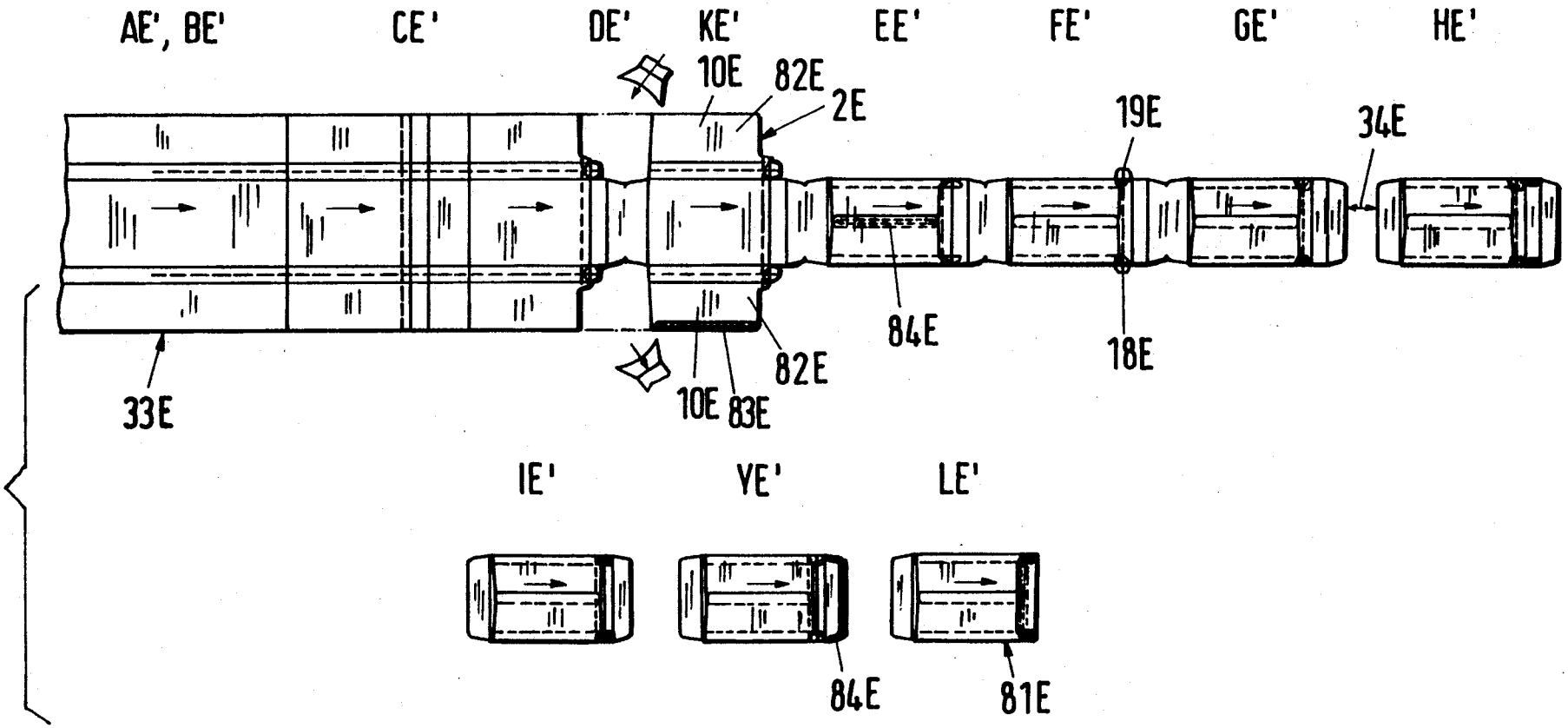
FIG. 21 is an illustration similar to that of FIG. 20, however, illustrating the production from a continuous web of sheet material.

FIGS. 20 and 21 again illustrate the production of the blank 2E to form the pouch 81E, including the individual folding operations and other steps, whereby these steps and operations again correspond identically or in an analog manner to the description of the first example embodiment. FIG. 20 shows the production from a precut blank 2E'. FIG. 21 shows the production from a continuous web 33E.

Referring to FIG. 20, the back portion half sections 82E are formed by the side flaps outer sections 10E which are, for this purpose, substantially larger than the respective outer sections in the example embodiments described above. The back portion 4E is very short. The bottom portion 5E receives its final configuration only during the method step DE when the bottom side tongues are simultaneously formed. Between the method step DE and the folding operation according to step EE, there is a step KE during which a glue or adhesive track is applied to one of the half sections 82E for forming the adhesive bonding 83E. Thus, during step EE, the inner and outer folding sections 8E and 9E are folded over and laid onto one another as shown in FIG. 18, and in addition during this step the half sections 82E are closed, so that a hose type intermediate product is formed.

The further method steps FE to IE are again identical to the respective steps in the other embodiment. However, for producing the pouch 81E, an intermediate step YE is performed in which the short back portion 4E is provided with a glue track 84E for closing, or rather connecting the two back portion sections 82E. The actual closing then takes place during step LE which finishes the pouch 81E.

FIG. 21 illustrates the individual method steps corresponding to those of FIG. 20, however, using a continuous material web 33E rather than a precut blank. The severing cut 34E takes place after the back portion sections 82E have been closed to form a hose type intermediate product. According to step FE', the bottom side tongues 18E and 19E are tilted outwardly in the half product, and according to step GE', they are folded inwardly. All other method steps are the same as in the above described example embodiments.

Figure 22:
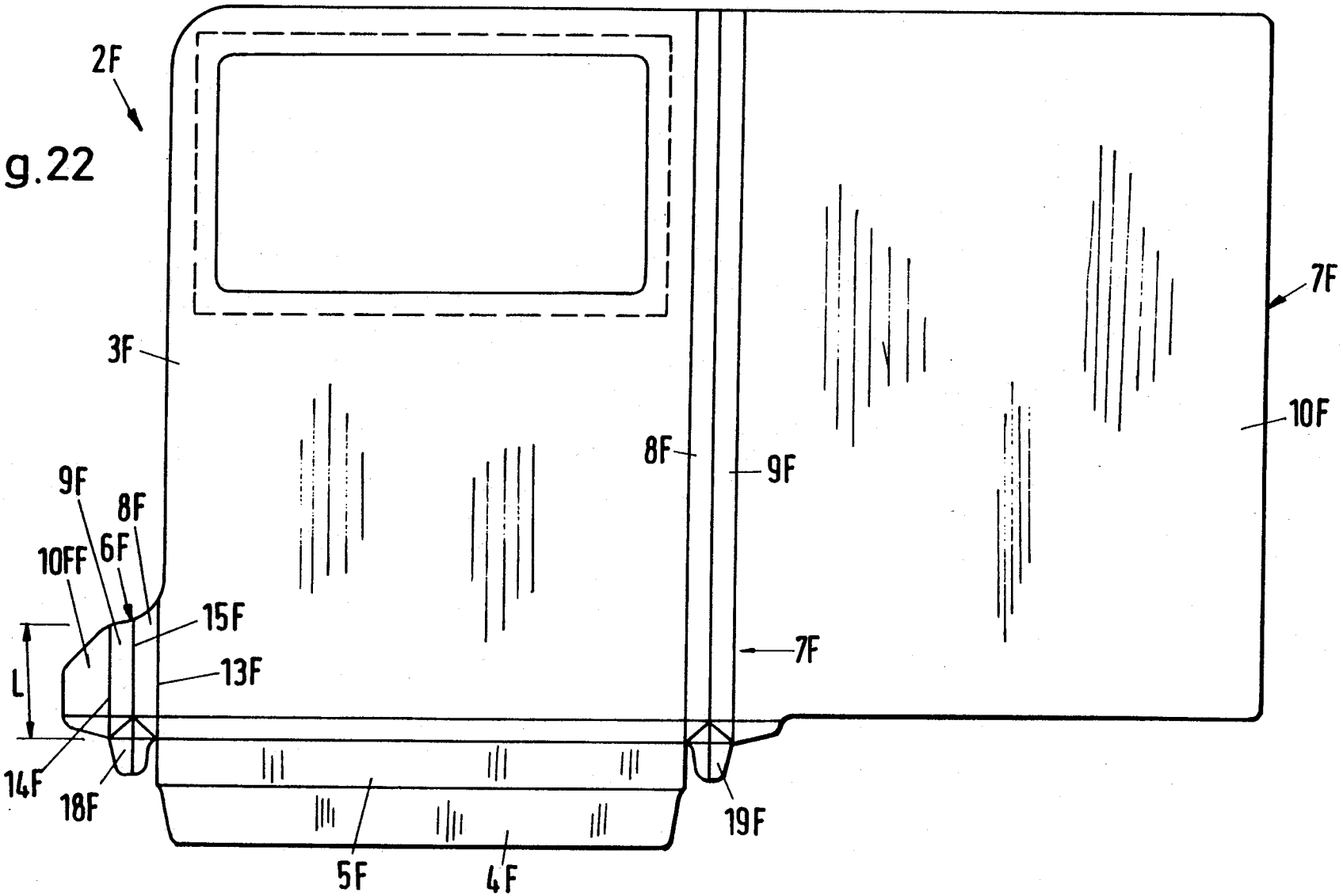
FIG. 22 shows a developed view of a blank for producing a file wrapper with its long side up.
Figure 23:
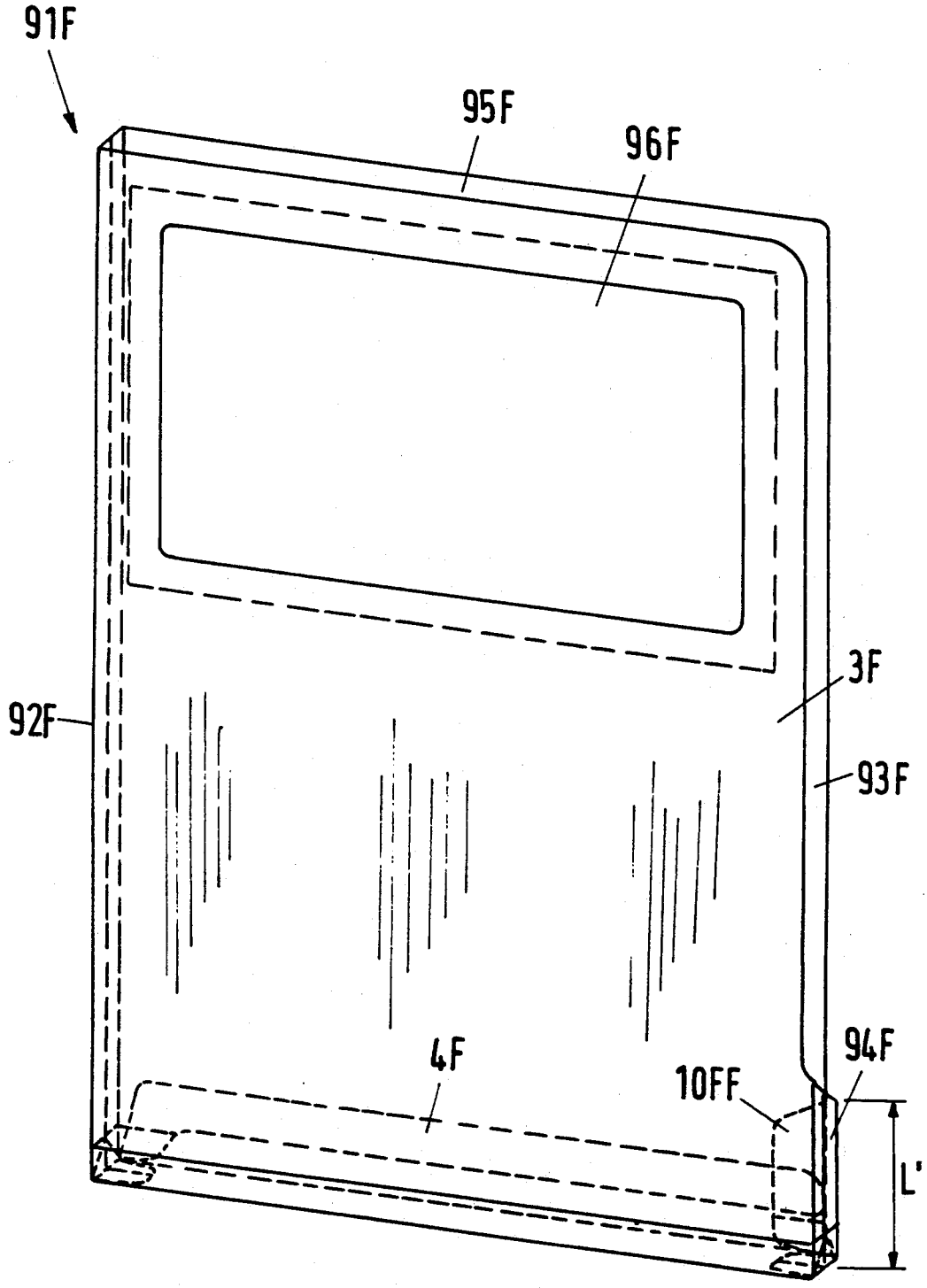
FIG. 23 is a perspective view of the file wrapper produced from the blank according to FIG. 22.

FIG. 22 shows a blank 2F for a file folder 91F having a long side up format as perspectively shown in FIG. 23.

The file folder 91F is closed at its bottom along a narrow side 92F. The other narrow side 93F is only closed at its lower end 94F and otherwise it is open. The file folder 91F is also open along its entire upper end 95F. The file folder may be provided with a view window 96F or the like as shown on the front portion 3F in FIGS. 22 and 23.

The back portion 4F is very short and forms a gluing tongue on the bottom portion 5F in the same manner as in the letter envelope 71D and in the shipping pouch 81E. Thus, the respective bottom portions 4D or 4E have a short back section functioning as a gluing tongue.

One of the side flap outer sections 10F corresponds, by reason of its dimensions, to the front portion 3F. The other side flap outer section 10FF functions as a gluing tongue and has a length in the direction of the longitudinal precreases 13F to 15F approximately corresponding to the length 1 of the closed lower section 94F along the narrow side 93F of the file folder 91F.

Figure 24:
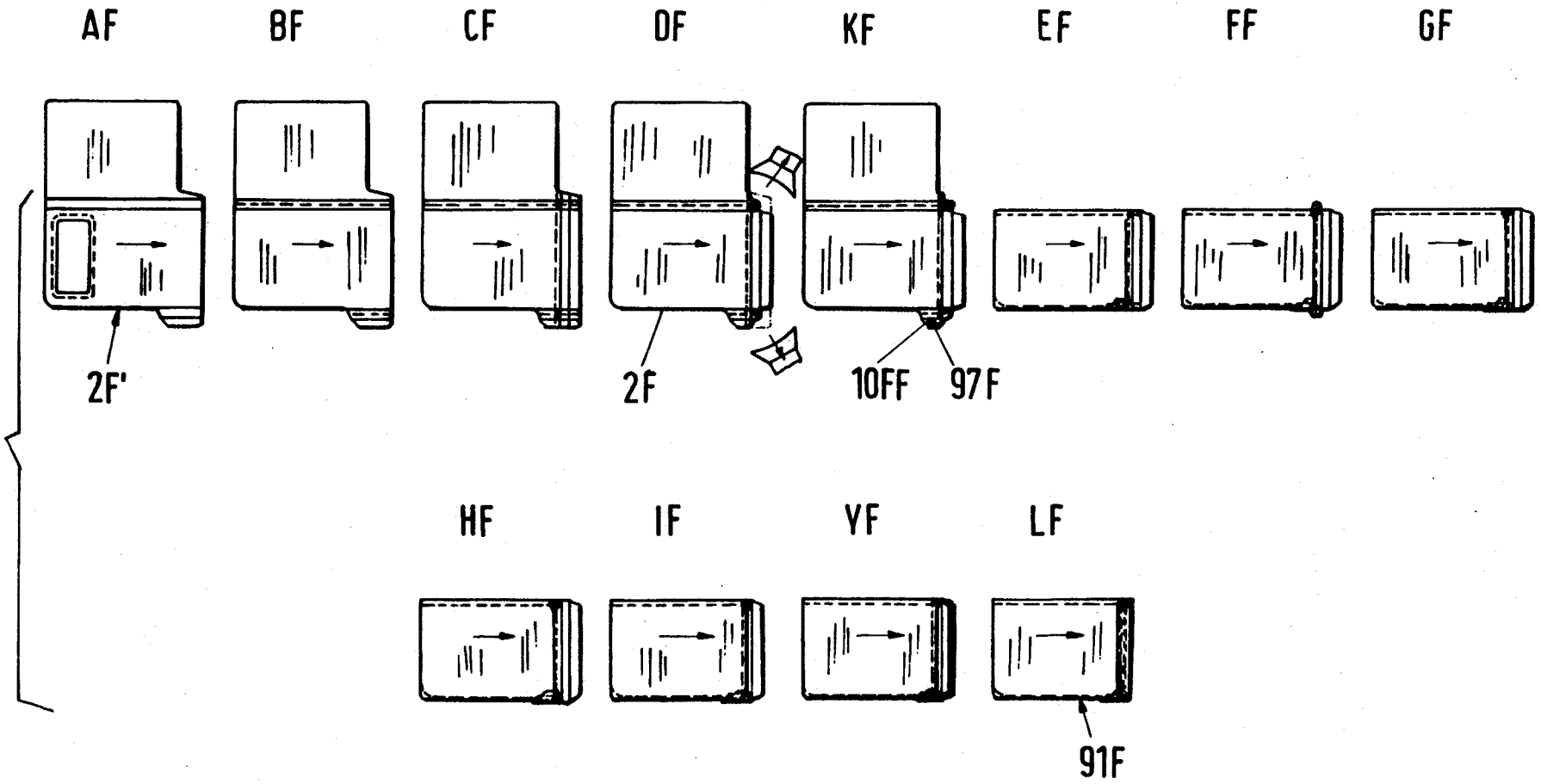
FIG. 24 illustrates the sequence of steps for producing a file wrapper according to FIG. 23, while starting from a precut blank.
Figure 25:
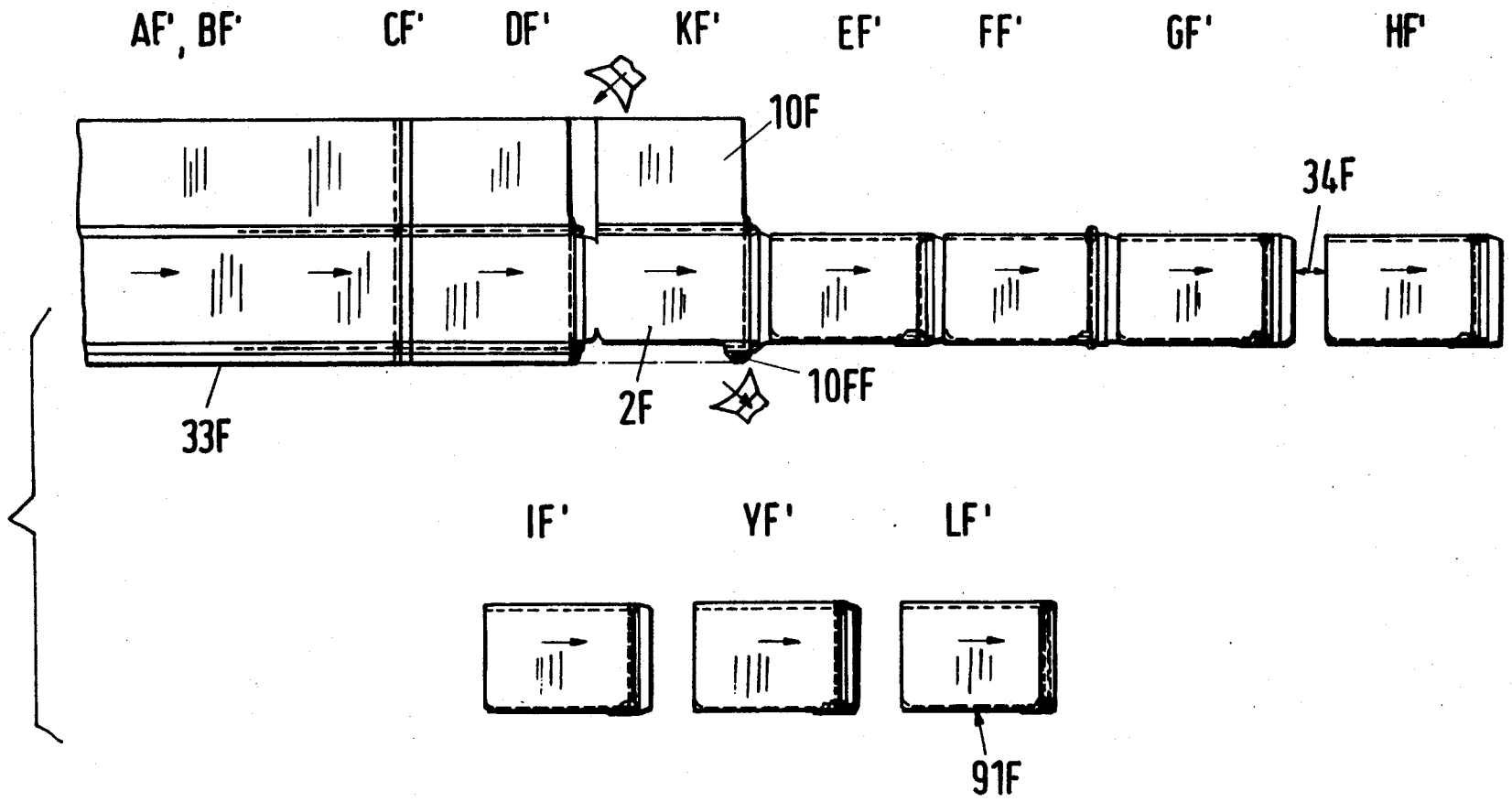
FIG. 25 illustrates the manufacturing steps for producing a file wrapper according to FIG. 24 when starting with a continuous web of sheet material from a roller.

The special dimensions of the blank 2F aside, the individual method steps for producing the file folder 91F are again identical to those described above with reference to the other example embodiments. Again, the inner folding sections 8F are folded onto the front portion 3F, the outer folding sections 9F are folded onto the inner fold sections 8F. The side flap outer sections 10FF functioning as a gluing tongue, is flapped onto the shorter outer folding section 9F and is secured by means of glue with the other side flap outer section 10F forming the back. For closing the bottom, the bottom portion 4F is connected with the aid of glue with the large side flap outer section 10F after the bottom side tongues 18F and 19F have been folded together and after they have been tilted outwardly by 90° and finally flapped inwardly again, as shown in FIG. 24 with reference to steps AF to LF for a precut blank 2F'. Here again, an intermediate step KF is performed between the steps DF and EF. A glue track 97F is applied onto the short side flap outer sections 10FF during step KF. During step EF, the sections in the side portions are folded, and in addition, the half product that will result in the file folder 91F is closed to form a hose-type intermediate product in the same manner as is shown at step EE in FIG. 20 for the shipping pouch 81E. FIG. 25 shows the production of the file folder 91F out of a continuous material web 33F. A characteristic feature is the large side flap outer section 10F forming the back of the file folder 91F, as well as the short side flap outer section 10FF that functions as a gluing tongue. The very short side flap outer section 10F is formed simultaneously with the correspondingly inner and outer fold sections 8F and 9F during the step DF' which also forms the contour of the blank 2F. All other method steps are identical or correspond in analogy to the steps described above with reference to the other example embodiments.

Although the invention has been described with reference to specific example embodiments it will be appreciated that it is intended to cover all modifications and equivalents within the scope of the appended claims.

What I claim is:

1. A method for producing from a blank (2') an enclosure having a front portion (3), a back portion (4), side flaps (6, 7), a bottom (5) bridging a spacing between said front portion (3) and said back portion (4), said bottom (5) forming an integral one piece component of said front portion and of said back portion (4), each of said side flaps (6, 7) comprising a bottom side tongue (18, 19), and a number of old lines (13, 14, 15), said enclosure further having a back-foldable section (25, 25C), and a folding precrease (24) between said back-foldable section (25, 25C) and said front portion (3), said folding precrease (24) functioning as a hinge for said back-foldable section (25, 25C) to be folded onto said front portion (3) in an empty condition of said enclosure, whereby said enclosure can be laid flat when empty and provides a substantial space between said front portion (3) and said back portion (4) when filled, said blank having a front section (3), a back section (4), side flap sections (6, 7), a bottom section (5), and a back-foldable section (25, 25C), said method comprising the following steps:

A) producing in said side flap sections (6, 7) longitudinal first hinging precreases (13, 14) to form respective enclosure corners along said fold lines;

B) producing in said side flap sections (6, 7) longitudinal second hinging precreases (15) for forming a fold;

C) producing third crosswise precreases (20, 21, 24) in said bottom section (5) for folding said back-foldable section (25, 25C) and fourth angular precreases (30) in said side flap sections (6, 7) near said bottom (5) section for folding said bottom side tongues (18, 19);

D) cutting said blank to form said bottom side tongues (18, 19);

E) folding said side flap sections (6, 7) to form folding sections (8, 9) extending along said second hinging precreases (15) for displacing said side flap sections (6, 7) into said enclosure, whereby said folding sections (8, 9) are placed onto each other in said flat empty condition of said enclosure and said bottom side tongues (18, 19) come to rest against said bottom section (5);

F) flapping and pulling said bottom side tongues (18, 19) about respective ones of said third precreases (24) operating as back and forth folding precreases and further flapping said bottom side tongues (18, 19) about said fourth angular precreases (30) while tilting said bottom side tongues (18, 19) around 90°, whereby said bottom side tongues (18, 19) open up away from said blank;

G) folding said bottom side tongues (18, 19) toward the center of the blank said blank, whereby said bottom side tongues (18, 19) contact portions (10) of said folding sections (9);

H) applying first adhesive for securing said bottom section (5) to said bottom side tongues (18, 19);

I) back-folding said back-foldable section (25, 25C) in a Z-configuration onto said bottom section (5), whereby simultaneously said bottom side tongues (18, 19) are flapped onto said bottom section (5);

K) applying second adhesive for securing said side flap sections (6, 7) to said back section (4); and L) folding and closing said back section (4), whereby said second adhesive bonds said side flaps (6, 7) to said back portion (4), and said enclosure has a flat bottom that enables the enclosure to stand on said bottom in an unfolded condition and that rests flat against said enclosure in a folded condition.

2. The method of claim 1, further comprising producing said blank from a continuous web supplied by a supply roller, and performing a severing ut (34) following said folding step of said bottom side tongues (18, 19) toward said blank (2') and prior to said first adhesive applying step.

* * * * *

UNITED STATES PATENT AND TRADEMARK OFFICE

CERTIFICATE OF CORRECTION

PATENT NO. : 5,292,300

DATED : March 8, 1994

INVENTOR(S) : Martin Bluemle

It is certified that error appears in the above-identified patent and that said Letters Patent is hereby corrected as shown below:

on the title page, in [30] "Foreign Application Priority Data" replace "Japan" by --Federal Republic of Germany--;

Column 11, line 12, replace "old" by --fold--;

Column 11, line 38, replace "bottom (5) section" by --bottom section (5)--;

Column 12, line 37, replace "ut" by --cut--.

Signed and Sealed this

Second Day of August, 1994

*Attest:*

*Attesting Officer*

BRUCE LEHMAN

*Commissioner of Patents and Trademarks*